US008573025B2

(12) United States Patent
Schier et al.

(10) Patent No.: US 8,573,025 B2
(45) Date of Patent: Nov. 5, 2013

(54) HOT STRETCH FORMING DIE HAVING DISTORTION-MINIMIZING CHARACTERISTICS

(75) Inventors: Joseph Alan Schier, La Canada, CA (US); Carlos San Martin, Montebello, CA (US); Timothy P. Fillmore, LaHabra, CA (US)

(73) Assignee: RTI International Metals, Inc., Niles, OH (US)

( * ) Notice: Subject to any disclaimer, the term of this patent is extended or adjusted under 35 U.S.C. 154(b) by 0 days.

(21) Appl. No.: 13/464,106

(22) Filed: May 4, 2012

(65) Prior Publication Data

US 2012/0216592 A1 Aug. 30, 2012

Related U.S. Application Data

(62) Division of application No. 12/546,361, filed on Aug. 24, 2009, now Pat. No. 8,210,020.

(60) Provisional application No. 61/155,352, filed on Feb. 25, 2009.

(51) Int. Cl.
*B21D 11/02* (2006.01)

(52) U.S. Cl.
USPC ..... 72/465.1; 72/296; 72/392

(58) Field of Classification Search
USPC ..... 72/295, 296, 302, 392, 413, 465.1, 466, 72/466.8, 473, 476, 477, 478, 481.1; 76/107.1
See application file for complete search history.

(56) References Cited

U.S. PATENT DOCUMENTS

| | | | | |
|---|---|---|---|---|
| 483,094 | A * | 9/1892 | Ansted | 72/413 |
| 1,178,020 | A | 4/1916 | Leonard | |
| 2,406,182 | A | 9/1943 | Zeitz | |
| 2,752,982 | A | 7/1957 | Lalli | |
| 2,868,264 | A | 1/1959 | Jones | |
| 3,181,331 | A | 5/1965 | Wishing | |
| 3,426,569 | A | 2/1969 | Brauer et al. | |
| 3,974,673 | A | 8/1976 | Fosness et al. | |
| 4,011,429 | A | 3/1977 | Morris et al. | |
| 4,242,899 | A | 1/1981 | Raymond | |
| 4,548,065 | A | 10/1985 | Vyhnal | |
| 5,119,535 | A | 6/1992 | Gnagy et al. | |
| 5,187,969 | A * | 2/1993 | Morita | 72/413 |

FOREIGN PATENT DOCUMENTS

JP 01180711 A * 7/1989

* cited by examiner

*Primary Examiner* — Teresa M Ekiert
(74) *Attorney, Agent, or Firm* — Sand & Sebolt

(57) ABSTRACT

A hot stretch wrap forming die typically includes a rigid backing section, a series of spaced ribs extending forward from the backing section, and an elongated face sheet secured to the ribs forward of the backing section with a convex forward-facing die face. The ribs elastically deflect during thermal expansion of the face sheet when a heated metal bar is forced against the die face so that the metal bar transfers heat to the face sheet. The die typically includes stiff ribs secured to the backing section and the face sheet which provide substantially fixed points for the face sheet during its thermal expansion. The face sheet may include several face sheet segments which together from the die face. The face sheet may also include contour plates which form respective portions of the die face and which may be used to adjust the specific contour of the die face.

24 Claims, 17 Drawing Sheets

HOT STRETCH FORMING DIE HAVING DISTORTION-MINIMIZING CHARACTERISTICS

CROSS REFERENCE TO RELATED APPLICATIONS

This application is a divisional of U.S. patent application Ser. No. 12/546,361, filed Aug. 24, 2009, which claimed priority from U.S. Provisional Patent Application Ser. No. 61/155,352, filed Feb. 25, 2009; the disclosures of which are incorporated herein by reference.

BACKGROUND OF THE INVENTION

1. Technical Field

The present invention is related generally to a hot stretch forming die and a method of using the same. More particularly, the invention relates to such a die which is configured to minimize the distortion of the die due to thermal expansion during the process of forcing a heated metal work piece against the die face. Specifically, the invention relates to such a die which also includes an adjustable die face to allow for the adjustment of the contour of the die.

2. Background Information

It is well known in the art of hot stretch forming to wrap a heated metal bar around the work surface or die face of a rigid die in order to bend the metal bar into a shape conforming to the contour of the die face. However, one of the problems that arises during this process is the thermal expansion of the die as heat is transferred from the metal bar to the die face and the rest of the die. Because there is a need to maintain an accurate shape or contour of the die during the hot stretch forming of the part, this thermal expansion of the die is normally significant enough to present a problem in controlling the resulting contour of the shaped metal bar. In addition, there is a need in the art to produce a final part which is within fairly close tolerances. Due to the difficulty in controlling various factors such as the precise temperature of the metal bar during the forming process and the fact that the part shrinks after the forming process as the part cools down, there are typically some trial and error corrections made to the die face or other aspects of the process in order to produce parts within the defined tolerances. This trial and error process may involve the production of an initial part by the hot forming process, testing to determine where the final part is out of tolerance, and the grinding of the die face in certain areas in order to provide the appropriate contour which will result in a subsequent part within the given tolerances. The present invention addresses these and other issues in the art.

BRIEF SUMMARY OF THE INVENTION

The present invention provides a hot stretch wrap forming die comprising: a support structure having a front and back defining therebetween an axial direction, left and right ends defining therebetween a longitudinal direction, and a forward-facing surface which is convex as viewed from above; a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face; wherein each of the contour plates has a first secured position secured to the support structure and an alternate second secured position secured to the support structure forward of the first secured position.

The present invention also provides a hot stretch wrap forming die comprising: a support structure having a front and back defining therebetween an axial direction, left and right ends defining therebetween a longitudinal direction, and a forward-facing surface which is convex as viewed from above; a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face and which are removably secured to the forward-facing surface.

The present invention further provides a hot stretch wrap forming die comprising: a support structure having a front and back defining therebetween an axial direction, left and right ends defining therebetween a longitudinal direction, and a forward-facing surface which is convex as viewed from above; a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face; a plurality of longitudinally elongated slots formed in one of (a) the support structure and (b) the contour plates respectively; a plurality of pins which extend between the support structure and the contour plates respectively; wherein the support structure and contour plates are configured to allow thermal expansion of each contour plate in the longitudinal direction relative to the support structure with the pins in the slots respectively.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
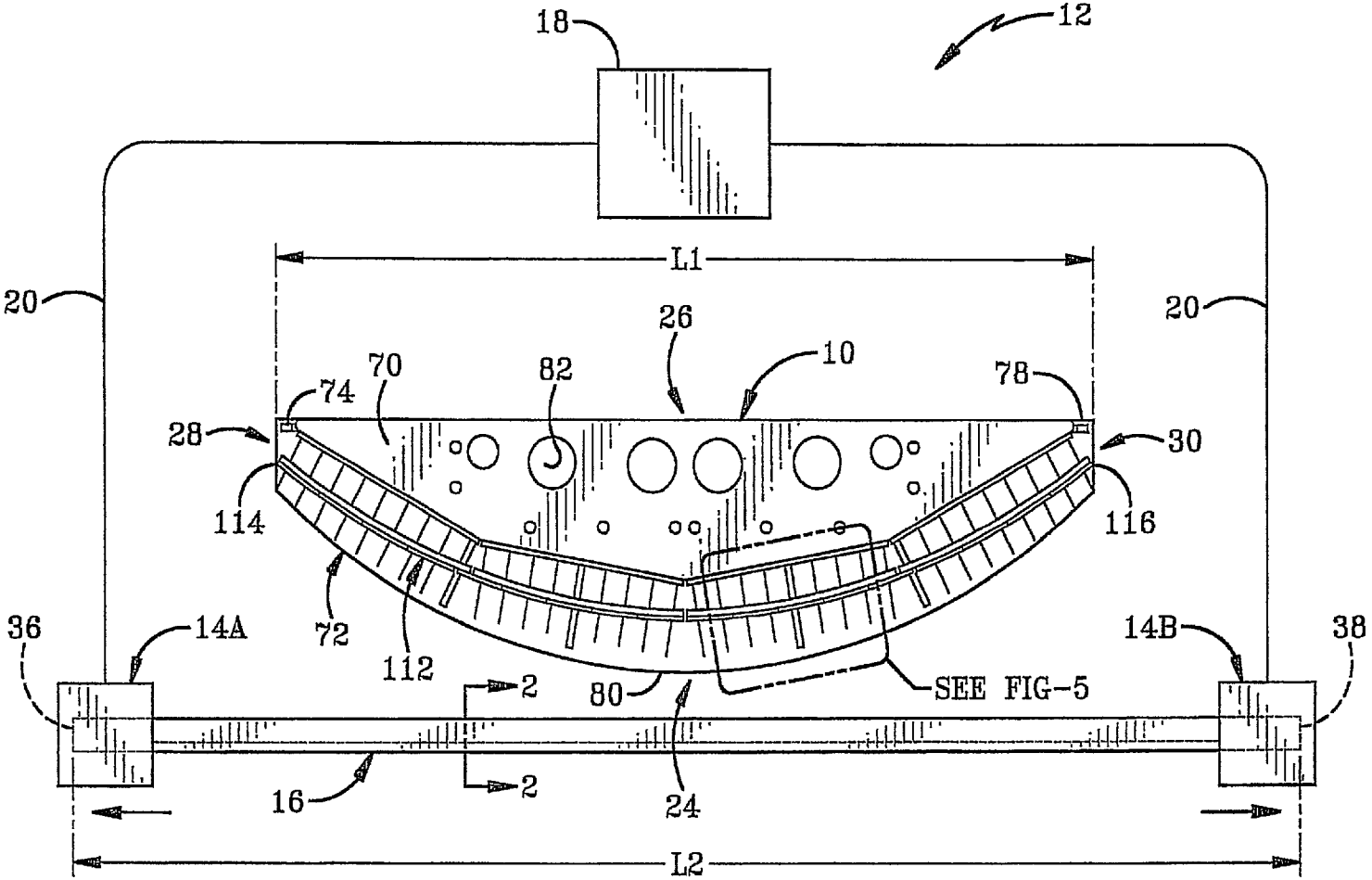
FIG. 1 is a diagrammatic view of the hot stretch forming apparatus of the invention in the pre-wrapping position showing the die in its home position and metal bar from above.

The die of the present invention is shown generally at 10 in FIG. 1 and is part of a hot stretch forming apparatus 12 which includes left and right jaws 14A and 14B which are configured to clamp the ends of a metal bar 16 to be shaped on die 10, an electric power source 18 and electrically conductive wires 20 in electrical communication with power source 18 and portions of the respective jaws 14A and 14B. More particularly, power source 18, wires 20, and portions of jaws 14A and B and metal bar 16 form an electrical circuit which may be selectively opened and closed in order to pass electrical current through metal bar 16 to heat metal bar 16 resistively due to its own electrical resistance. To prevent electrical shorting between metal bar 16 and die 10, a layer of electrical insulation such as layer 22 is positioned between the die face and metal bar to prevent contact between metal bar 16 and any metal portion of die 10 during the forming process. In the exemplary embodiment, layer 22 is a flexible layer of electrically insulated refractory material which is typically in the form of a refractory ceramic blanket such as that sold under the name Kaowool. Such ceramic blankets typically provide both thermally and electrically insulative properties and are formed of woven and ceramic fibers.

Although die 10, jaws 14 and metal bar 16 may be positioned in different orientations such as being generally vertically aligned, the figures show die 10 in a generally horizontal position with jaws 14 positioned to hold bar 16 in a substantially horizontal orientation such that metal bar 16 is generally at the same height as the die face against which metal bar 16 is forced during the hot stretch wrap forming process. Thus, although different orientations may be assumed, the description of apparatus 10 is described in this orientation for simplicity whereby die 10 has a front and back 24 and 26 defining therebetween an axial direction of die 10, and opposed left and right sides or ends 28 and 30 defining therebetween a longitudinal direction of die 10. Left and right ends 28 and 30 also define therebetween longitudinal length L1 of die 10. Layer 22 of insulation thus has left and right ends 32 and 34 which typically extend outwardly respectively beyond left and right sides or ends 28 and 30 of die 10 or at least the die face thereof to ensure that there is no electrical contact between metal bar 16 and the metal portions of die 10. Metal bar 16 has left and right ends 36 and 38 defining therebetween a length L2 of bar 16 which is greater than length L1 of die 10. Although length L1 and length L2 may obviously vary, length L1 in the exemplary embodiment is on the order of about 8 feet and typically falls within the range of about 6 to 10 feet or so. Length L2 is thus within a similar range and somewhat longer. However, these lengths may vary substantially depending on the length of the final part which is to be formed from metal bar 16.

Figure 2:
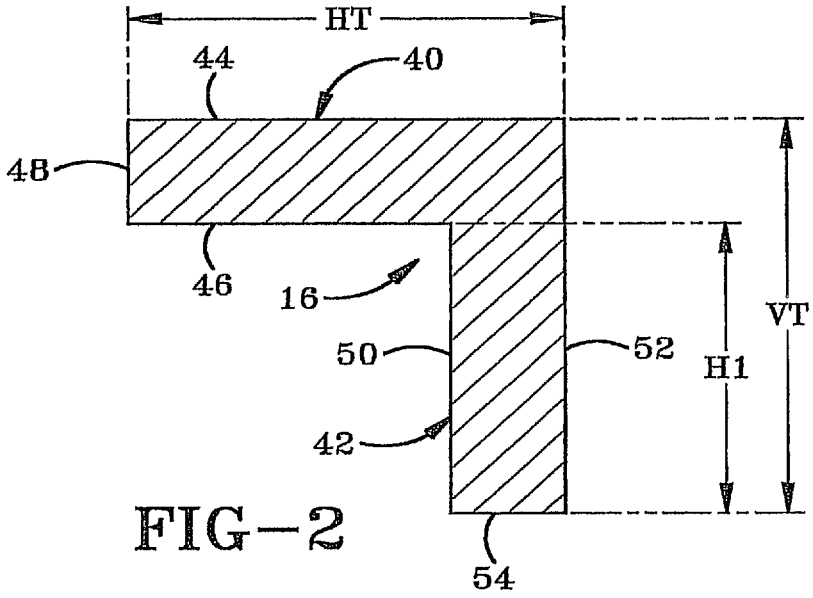
FIG. 2 is a sectional view of the metal bar taken on line 2-2 of FIG. 1.

As shown in FIG. 2, metal bar 16 is illustrated as an L-shaped bar or has an L-shaped cross-section. Thus, bar 16 has a horizontal upper leg 40 and a vertical lower leg 42 which is rigidly secured to and extends perpendicularly downwardly from horizontal leg 40 adjacent its front end in the orientation shown. In the exemplary embodiment, leg 40 has horizontal top and bottom surfaces 44 and 46 and a back terminal end 48. Vertical leg 42 has vertical back and front surfaces 50 and 52 and a bottom terminal end 54. Back terminal end 48 and front surface 52 also serve as the respective back and front of metal bar 16 and define therebetween a total horizontal thickness HT of bar 16. Similarly, top surface 44 and bottom terminal end 54 serve as the top and bottom of metal bar 16 and define therebetween a total vertical thickness VT of bar 16. The ratio of the total horizontal thickness to the total vertical thickness of metal bar 16 typically ranges from 1:1 to 10:1. Inasmuch as metal bar 16 is elongated from end to end, length L2 of metal bar 16 is substantially greater than either of horizontal thickness HT or vertical thickness VT. Typically, length L2 is at least 20 times that of either thickness HT or thickness VT, and is very often 25 to 50 times that of either of said thickness HT or VT, or any increment therebetween. Length L2 may be more than 50 times than that of thickness HT or VT depending on the specific circumstances. Back surface 50 of leg 42 serves as the engagement surface which is forced against die 10 during the hot stretch wrap forming process. Back surface 50 has a vertical dimension or height H1 defined between bottom surface 46 and bottom terminal end 54. Length L2 of metal bar 16 has a similar relationship to height H1 as to thicknesses HT and VT except that length L2 may be even greater with respect to height H1.

Figure 3:
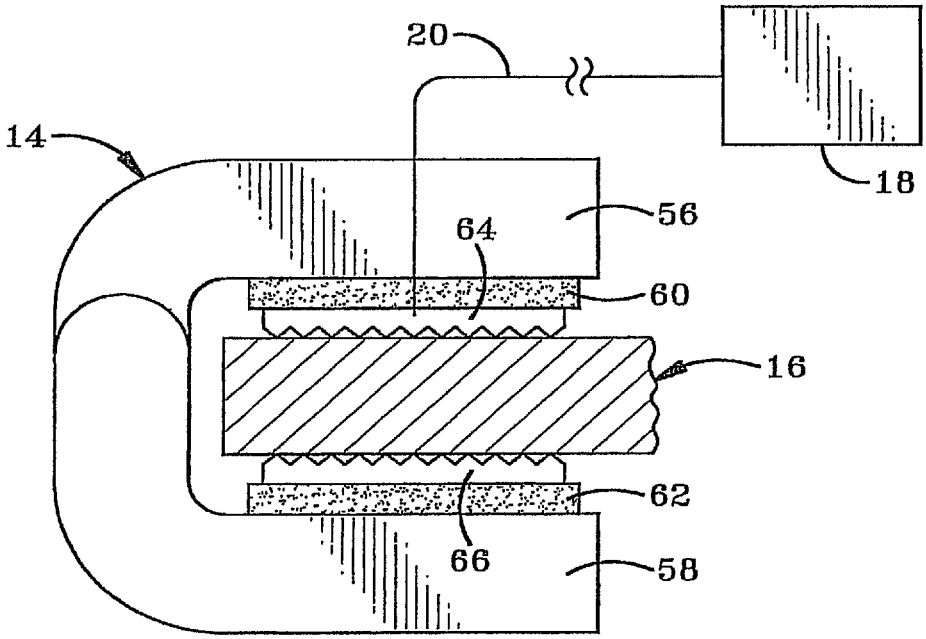
FIG. 3 is a diagrammatic view of one of the jaws gripping the metal bar and illustrating the electrical communication between the metal bar and electric power source via one of the gripping members of the jaw.
Figure 10:
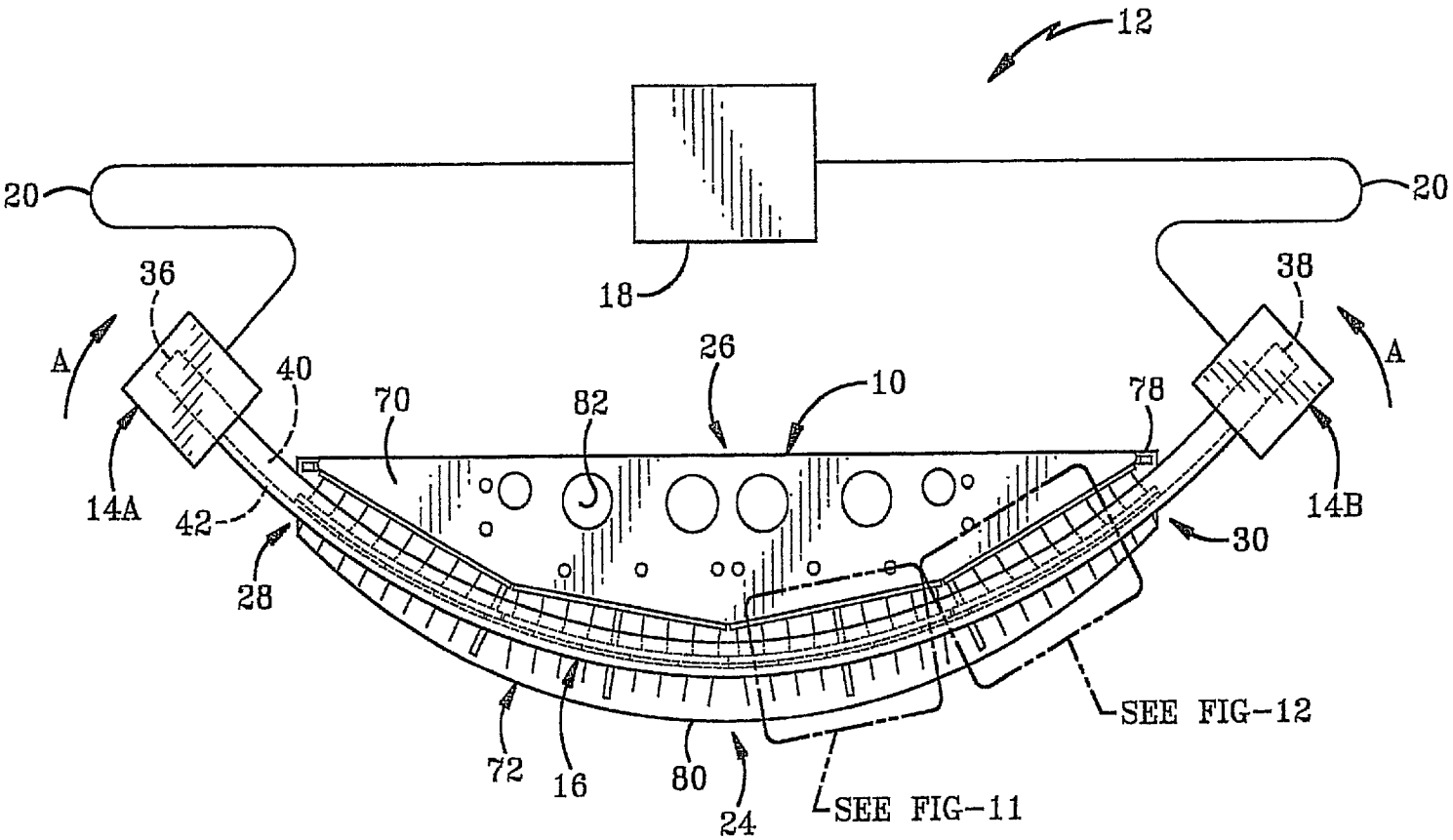
FIG. 10 is similar to FIG. 1 and shows the jaws having moved to bend the heated metal bar around the die face such that the metal bar is in the wrapped position and the die face and adjacent structure have moved to the thermally expanded position as a result of heat transferred from the hot metal bar to the die face.

Each jaw 14 (FIG. 3) includes first and second arms 56 and 58, first and second electrical insulation members 60 and 62, and first and second gripping members 64 and 66. First insulation member 60 is secured to first arm 56 with first gripping member 64 secured to insulation member 60 opposite first arm 56 such that third gripping member 64 is electrically isolated from first arm 56 via insulation member 60. Likewise, second insulation member 62 is secured to the second arm 58 with second gripping member 66 secured to insulation member 62 opposite second arm 58 such that gripping member 66 is electrically isolated from arm 58 via insulation member 62. Gripping members 64 and 66 define therebetween a receiving space for receiving therein a portion of metal bar 16 such that gripping members 64 and 66 of the respective jaws 14 can tightly grip metal bar 16 adjacent the respective ends 36 and 38 thereof in a clamping fashion. Arms 56 and 58 are thus movable relative to one another between a non-clamping position and a clamping position for respectively releasing and clamping metal bar 16 adjacent the respective end thereof. The clamping action of arms 56 and 58 are typically hydraulically powered although other such mechanisms may be used for this purpose. In the exemplary embodiment, one of wires 20 is in electrical communication with one of the gripping members, which is in electrical communication with bar 16 when jaw 14 is clamped onto bar 16. Thus, the electrical circuit discussed above further includes one of the gripping members of each jaw 14. However, wires 20 or another electrically conductive member may be in direct electrical contact with metal bar 16 instead of via one of the gripping members if desired. The set of jaws 14 is configured for movement relative to one another and relative to die 10 between the home position or pre-wrapping position shown in FIG. 1 and the wrapped position shown in FIG. 10, which may also be referred to as the final position of metal bar 16 or the holding position of metal bar 16. More particularly, jaws 14 may be moved toward or away from one another in a longitudinal direction as well as forward and backward in the back sealed direction.

With reference to FIGS. 2-8, die 10 is now described in greater detail. FIGS. 2-8 show die 10 in its home position, that is, prior to the hot stretch wrapping of bar 16 around the die face of die 10. In the exemplary embodiment, die 10 is not heated by any heating elements or other heat source besides the heat which is transferred from metal bar 16 to the die during the forming process. The temperature of die 10 in the home position is thus typically a standard room temperature such as in the range of about 60-80° F. and more broadly usually within the range of about 50-100° F. However, the temperature of die 10 in the home position may be higher than 100° F. especially when die 10 is being used to form multiple contoured metal bars and thus may be heated above the standard room temperature due to residual heat which was transferred to the die from one metal bar which has been removed from die 10 and prior to the hot stretch forming of a subsequent metal bar.

Die 10 is a rigid structure which is typically formed primarily of metal. In the exemplary embodiment, most of the components of die 10 are formed of a carbon steel with some of the components typically formed of stainless steel, such as those components adjacent the die face or work surface thereof. In general, die 10 is generally convexly curved adjacent its front 24 and generally straight adjacent its back or rear 26 although this may vary. Die 10 includes a rigid structure or backing section 68 which includes a generally horizontal metal top wall 70, a generally horizontal metal bottom wall 72, a generally vertical metal back wall 74 and a generally vertical metal front wall 76. These walls together form a backing section 68 and are longitudinally elongated from adjacent left end 28 to adjacent right end 30. Bottom wall 72 has a straight longitudinally extending back edge 78 and a convexly curved longitudinally extending front edge 80, as viewed from above. Back wall 74 is rigidly secured to and extends upwardly from the bottom wall 72 adjacent back edge 78. Top wall 70 is rigidly secured to and extends forward from the top of back wall 74 part way to front edge 80, terminating intermediate front and back edges 78 and 80. Front wall 76 is rigidly secured to bottom wall 72 intermediate front and back edges 78 and extends upwardly therefrom so that its top end forms a rigid connection with the front of top wall 70. Walls 70, 72, 74 and 76 thus define therewithin an interior chamber 82 whereby backing section 68 is a generally hollow structure although metal reinforcing ribs noted further below extend within interior chamber 82 to provide additional strength to the structure of die 10. The figures show several un-numbered circular holes formed in top wall 70, and similar holes may be formed in the bottom wall and back wall, etc.

In the exemplary embodiment, each of top wall 70, bottom wall 72 and back wall 74 is formed of a single flat rigid plate. However, front wall 76 in the exemplary embodiment is formed in four plate segments which are angled relative to one another such that the central part of front wall 76 is spaced forward of back wall 74 a greater distance than is its left and right ends. In particular, front wall 76 in the exemplary embodiment includes a straight far left wall segment 84, a straight central left wall segment 86, a straight central right wall segment 88 and a straight far right wall segment 90. Front wall 76 may be formed as a single piece which is bent into the four wall segments, or may be formed as separate wall segments which may or may not be directly secured to one another although they are typically rigidly secured to the top and bottom walls of backing section 68. Each of the wall segments of front wall 76 thus extend upwardly to a rigid connection with respective front edge segments of front edge 92 of top wall 70. More particularly, front edge 92 has straight edge segments including a far left edge segment 94, a central left edge segment 96, a central right edge segment 98 and a far right edge segment 100 which are angled relative to one another in the same manner as are the segments of front wall 76.

More particularly, die 10 as a whole is substantially bilaterally symmetrical about a vertical plane P1 which extends in the axial direction of die 10 from the front 24 to back 26 perpendicular to back wall 74 and cuts through the longitudinal center of die 10. Thus, the right end of central left edge segment 96 intersects the left end of central right edge segment 98 and angles rearwardly and to the left so that the left end of segment 96 is further rearward and thus closer to back wall 74 than is the right end of segment 96. Similarly, the right end of far left edge segment 94 intersects the left end of edge segment 96 and angles rearwardly therefrom so that the left end of edge segment 94 is further rearward than its right end and in the exemplary embodiment is adjacent back wall 74 and left end 28 of die 10. Central right edge segment 98 angles rearwardly to the right from its left end to its right end, which is thus disposed further rearwardly and closer to back wall 74 than is the left end of segment 98. The left end of far left edge segment 100 intersects the right end of segment 98 and angles rearwardly and to the right therefrom to its right end, which is thus further rearward than its left end and in the exemplary embodiment is adjacent back wall 74 and right end 30 of die 10.

Wall segments 84, 86, 88 and 90 angle in the same manner with respect to one another as do edge segments 94, 96, 98 and 100. Thus, the right end of central left wall segment 86 and the left end of central right wall segment 88 are adjacent or intersect one another. Similarly, the right end of far left wall 84 and the left end of central left wall 86 are adjacent or intersect one another. Likewise, the right end of central right wall segment 88 and the left end of far right wall segment 90 are adjacent or intersect one another. The left end of far left wall segment 84 is adjacent back wall 74 and left end 28 while the right end of far right wall segment 90 is adjacent back wall 74 and right end 30.

Die 10 further includes a far left set 102 (FIG. 4) of evenly spaced metal ribs, a central left set 104 of evenly spaced metal ribs, a central right set 106 of evenly spaced metal ribs, and far right set 108 of evenly spaced metal ribs all of which are rigidly secured to and extend between top wall 70 and bottom wall 72 to provide additional strength to die 10. These various ribs in sets 102, 104, 106 and 108 extend through respective vertical slots 111 (FIGS. 6, 8, 9) formed in front wall 76. As more particularly shown in FIGS. 4A and 4B, set 102 includes eight longitudinally spaced thinner ribs 103A-H, set 104 includes eight longitudinally spaced thinner ribs 105A-H, set 106 includes eight longitudinally spaced thinner ribs 107A-H, and set 108 includes eight longitudinally spaced thinner ribs 109A-H. Set 102 also includes a thicker rib 110A which extends adjacent the right end of far left front wall segment 84 and is spaced longitudinally to the right of rib 103H and to the left of rib 105A. Set 104 further includes a centrally located thicker rib 110B which is midway between the left and right ends of central left front wall segment 86 and is longitudinally spaced to the right of rib 105D and to the left of rib 105E. Likewise, set 106 (FIG. 4B) includes a thicker rib 110C which is midway between the left and right ends of central right front wall segment 88 and is longitudinally spaced to the right of rib 107D and the left of rib 107E. Set 108 also includes a thicker rib 110D which extends adjacent the left end of far right wall segment 90 and is spaced longitudinally to the left of rib 109A and to the right of rib 107H.

Figure 6:
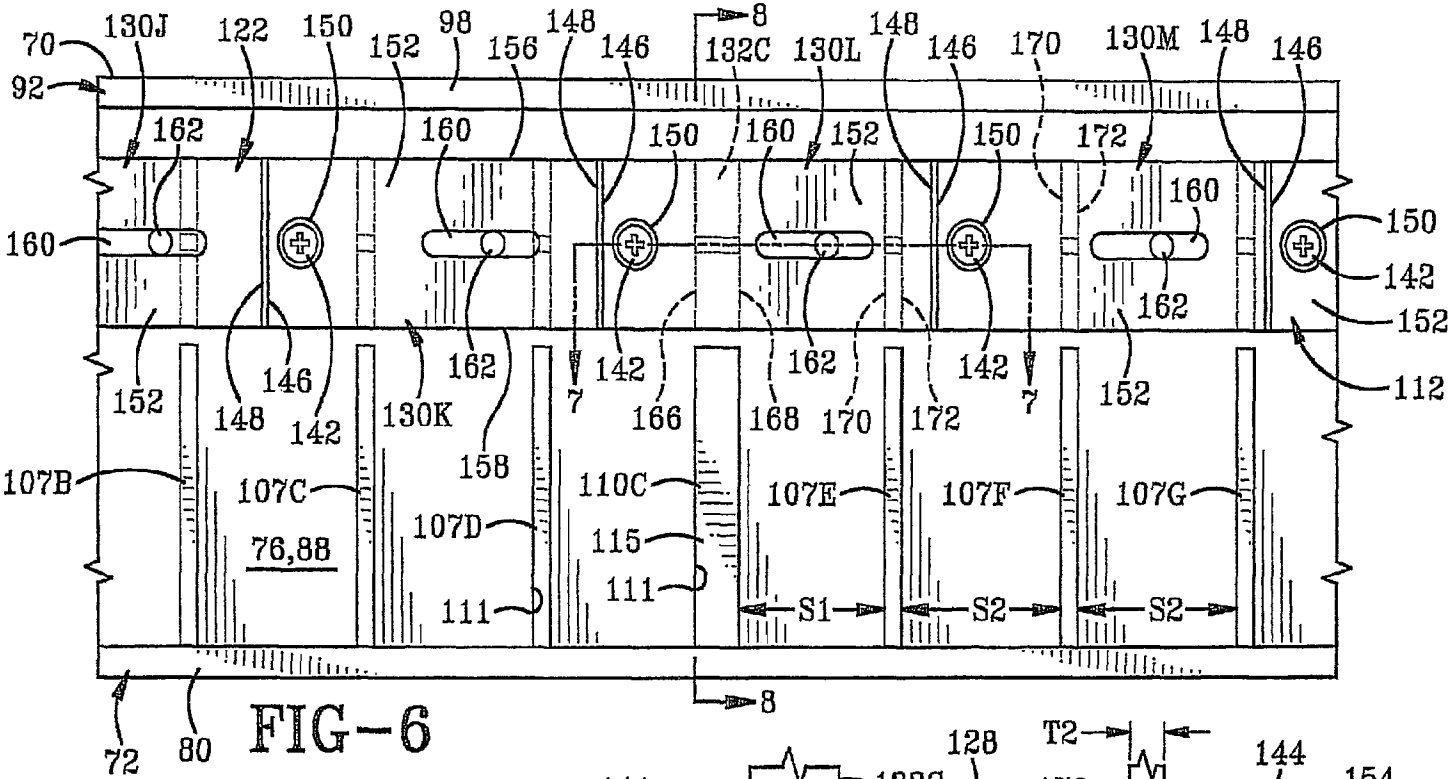
FIG. 6 is a front elevational view of the portion of the die face subassembly shown in FIG. 5.

All of these ribs are formed of substantially vertical flat plates such that the ribs within the respective one of sets 102, 104, 106 and 108 are substantially parallel to one another. All of these ribs with the possible exception of ribs 103A and 109H include a rectangular or square portion 113 (as viewed from the side; FIG. 6) disposed within interior chamber 82 of backing section 98 which extends from top wall 70 to bottom wall 72 and from the respective wall segment of front wall 76 rearwardly toward back wall 74. Each of the ribs also includes a triangular front section 115 as viewed from the side which extends forward from the respective wall segment of front wall 76 with the upper surfaces of the triangular sections 115 angling downwardly and forward to front points which intersect the upper surface of bottom wall 72 generally adjacent front edge 80 thereof. In the exemplary embodiment, the rectangular sections 113 of ribs 103E-H, 105B-G, 107B-G and 109A-D are of substantially the same dimensions. The rectangular segments 113 of ribs 103B-D and 109E-G are somewhat shorter due to their particular orientation and intersection with back wall 74. Similarly, the rectangular sections 113 of ribs 105A, 105H, 107A and 107H are relatively shorter inasmuch as rib 105A intersects thicker rib 110A within interior chamber 82, rib 105H and 107A intersect one another within interior chamber 82, and rib 107A intersects thicker rib 110D within interior chamber 82. Each of thicker ribs 110A-D extends rearwardly to intersect back wall 74 in the exemplary embodiment, with ribs 110A and 110D being the same length as one another and somewhat shorter than ribs 110B and 110C, which are the same length as one another.

Figure 4:
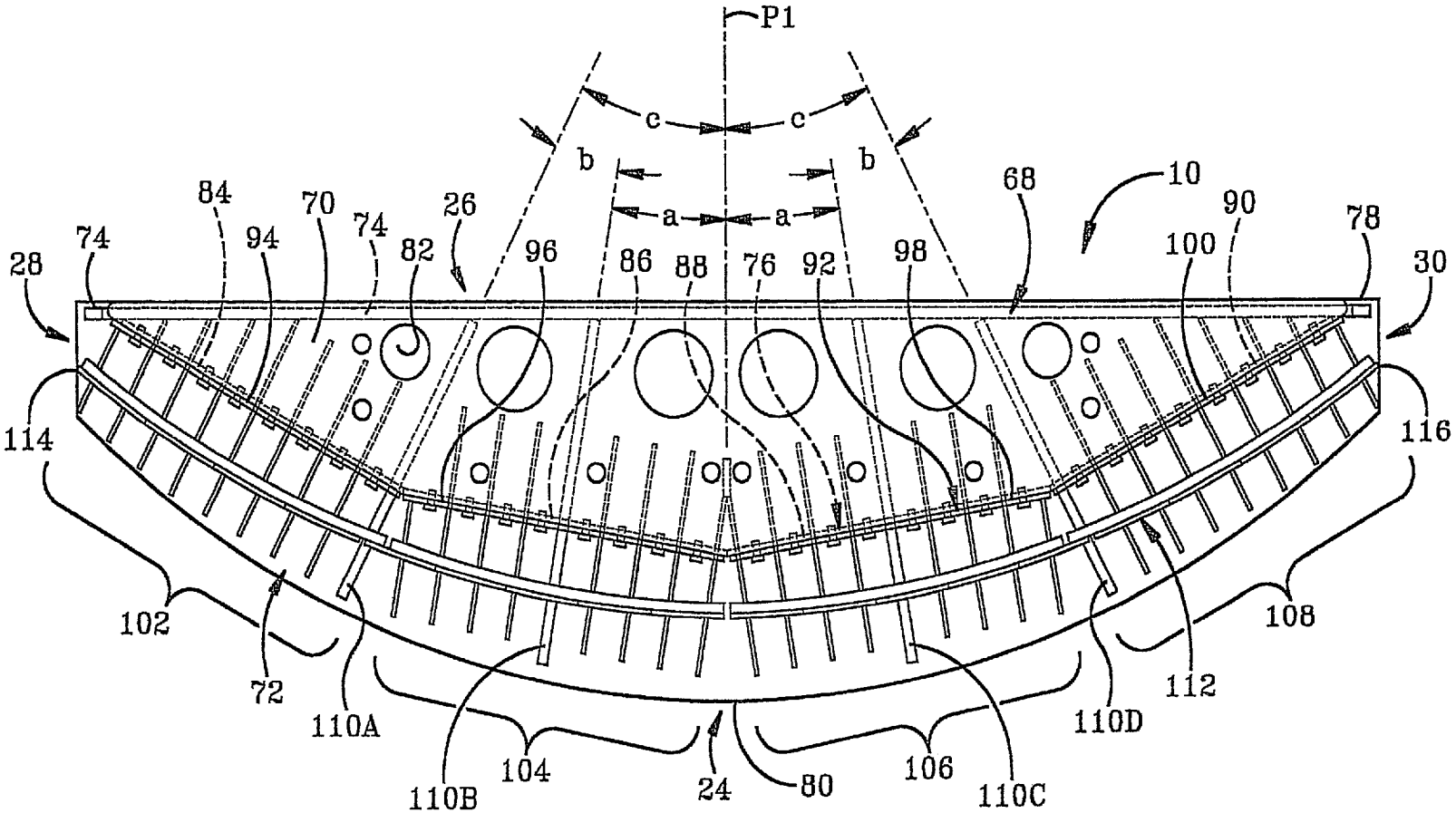
FIG. 4 is a top plan view of the die of the present invention in the home position.

Thinner ribs 105 and thicker rib 110B of set 104 angle forward and to the left so that each rib 105, 110B and plane P1 define therebetween an acute angle a (FIG. 4). Thinner ribs 103 and thicker rib 110A of set 102 also angle forward and to the left relative to ribs 105, 110B such that each rib 103, 110A and each rib 105, 110B define therebetween an acute angle b. Ribs 103, 110A also angle forward and to the left relative to plane P1 such that each rib 103, 110A and plane P1 define therebetween an acute angle c which is thus greater than each of angles a and b. Similarly, thinner ribs 107 and thicker rib 110C of set 106 angle forward and to the right such that each rib 107, 110C and plane P1 define therebetween angle a. Thinner ribs 109 and thicker rib 110D of set 108 also angle forward and to the right relative to ribs 107, 110C such that each rib 107, 110C and each rib 109, 110D define therebetween angle b. Ribs 109, 110D also angle forward and to the right relative to plane P1 such that each rib 109, 110D and plane P1 define therebetween angle c. FIG. 4 also illustrates that the ribs in set 104 and the ribs in set 106 define therebetween an acute angle which is equal to two times angle a. Likewise, the ribs in set 102 and the ribs in set 108 define therebetween an acute angle which is equal to two times angle c. The ribs in each set 102, 104, 106 and 108 angle forward and away from the ribs in each of the other sets such that the front end of a given rib in one set is further away from the front end of a given rib in another one of the sets than are the back ends of the two given ribs.

In the exemplary embodiment, angle a is on the order of about 10° and usually falls within the range of about 5 or 10° to about 15 or 20°. Thus, the angle noted above which is equal to two times angle a is in the exemplary embodiment about 20° and typically falls within the range of about 10 or 20° to about 30 or 40°. Angle b in the exemplary embodiment is on the order of about 20° and typically falls within the range of about 10 or 20° to 30 or 40°. Angle c in the exemplary embodiment is on the order of about 30° and typically falls within the range of about 20 or 25° to about 35 or 40°. Thus, the angle noted above which is two times angle c is in the exemplary embodiment about 60° and typically falls within the range of about 40 or 50° to about 70 or 80°. In the exemplary embodiment, each of ribs 103, 110A is substantially perpendicular to far left wall segment 84. Likewise, ribs 105, 1108 are substantially perpendicular to central wall segment 86, ribs 107, 110C are substantially perpendicular to central right wall segment 88 and ribs 109, 110D are substantially perpendicular to far right wall segment 90.

In accordance with some of the main features of the invention, die 10 includes a forward-facing die face 112 and adjacent supporting structure which accommodates the thermal expansion of the die face as well as allows for adjustability of the contour of the die face. More particularly, die face 112 and portions of its supporting structure undergo thermal expansion during the hot stretch forming of metal bar 16 while providing substantial dimensional stability to backing section 68. Die face 112 has left and right ends 114 and 116 closely adjacent left and right ends 28 and 30 of die 10. Die face 112 in the exemplary embodiment faces forward and curves convexly from left end 114 to right end 116 as viewed from above. In the exemplary embodiment, this convex curve is substantially constant although this may vary. As viewed from the side, die face 112 is substantially straight and vertical although this may vary particularly in accordance with the metal bar which is to be formed against the die face.

Figure 4A:
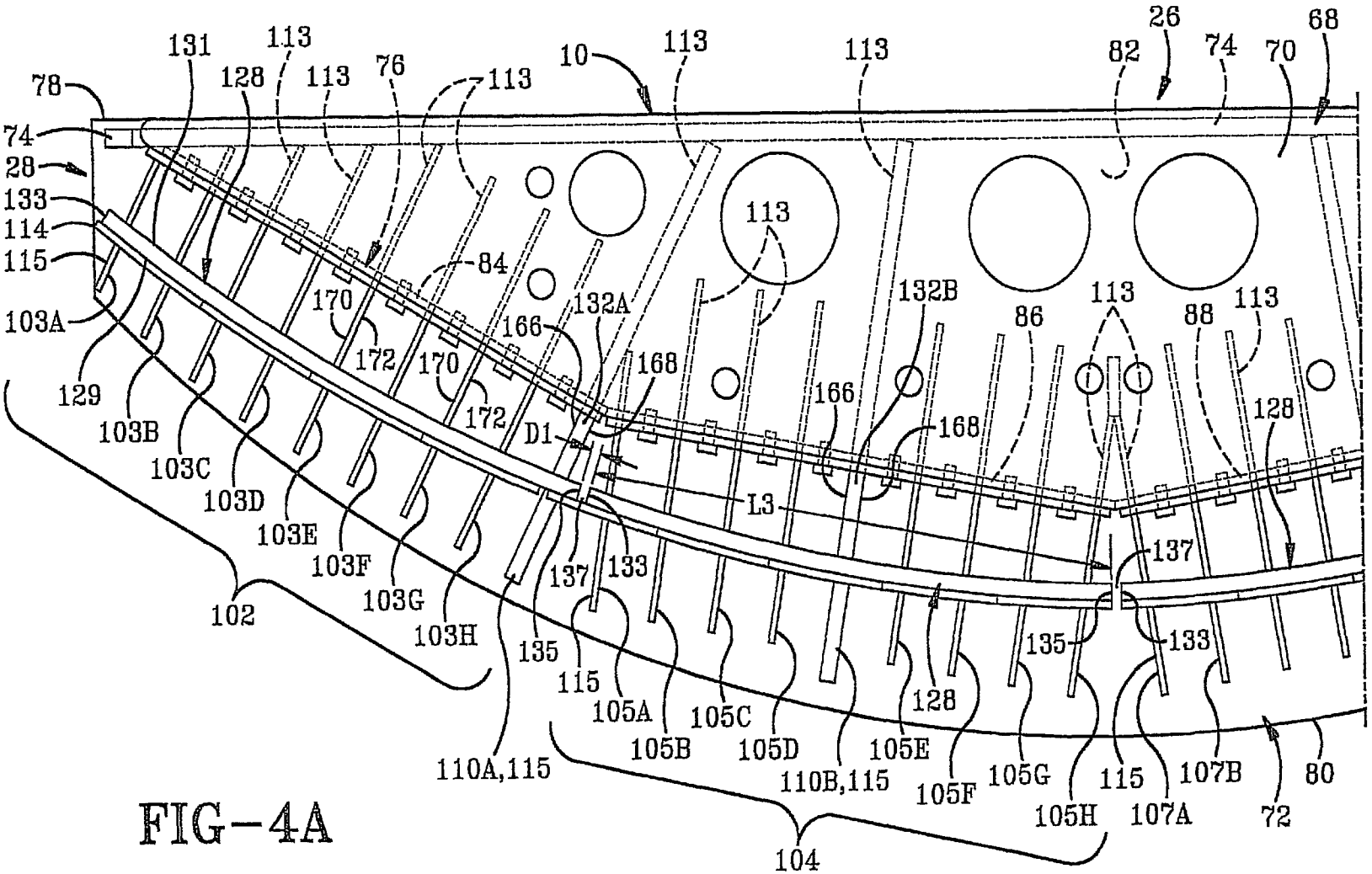
FIGS. 4A and 4B are respectively top plan views of the left and right sections of the die which are enlarged to primarily illustrate the various sets of strengthening ribs of the die.
Figure 4B:
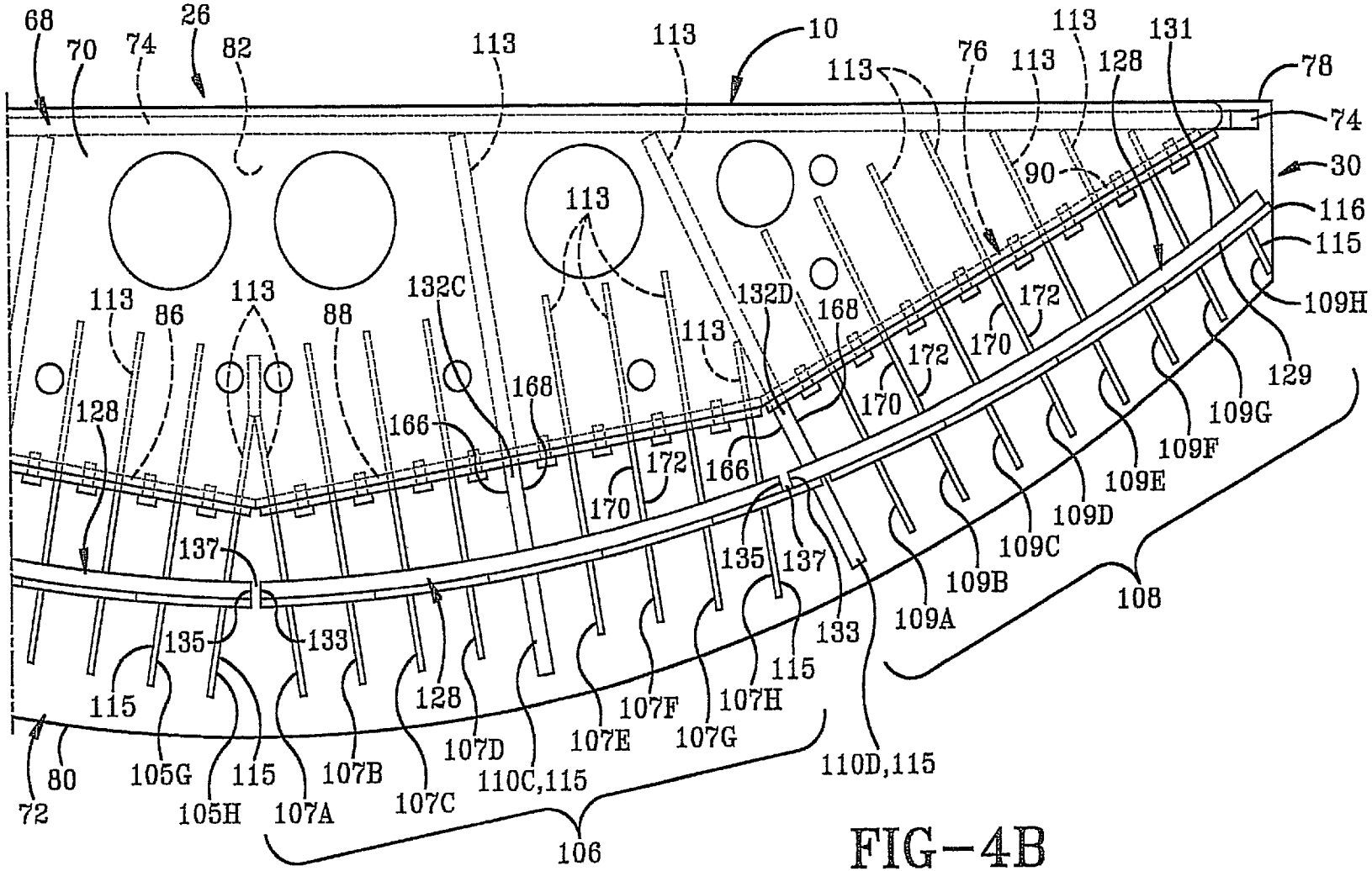
Figure 4C:
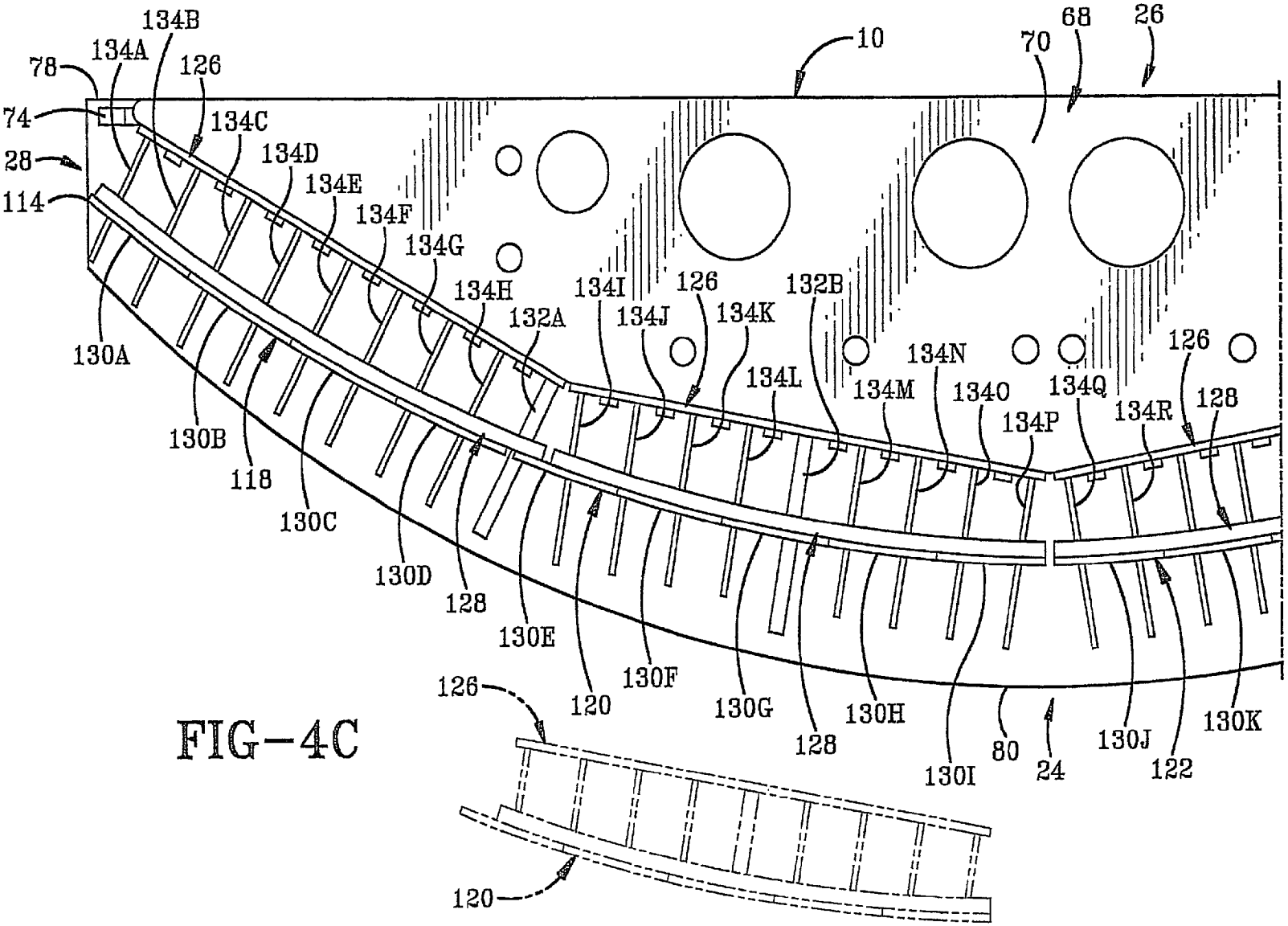
FIGS. 4C and 4D are similar to FIGS. 4A and 4B and are enlarged to primarily illustrate the die face subassemblies including the thicker stiff ribs and thinner elastically deformable ribs.
Figure 4D:
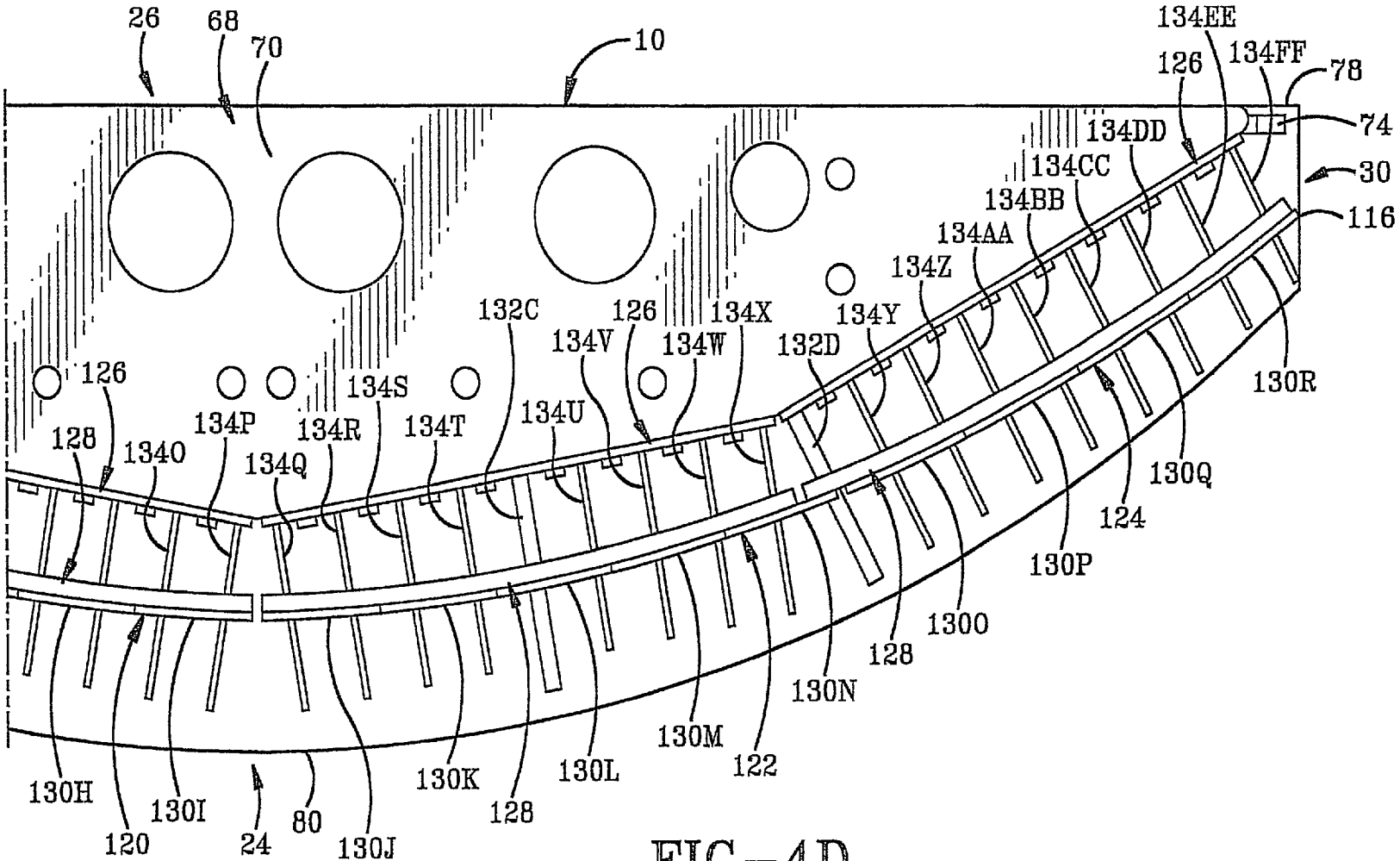

In the exemplary embodiment and with reference to FIGS. 4C and 4D, die face 112 is formed and supported by a rigid far left die face subassembly 118, a rigid central left die face subassembly 120, a rigid central right die face subassembly 122 and a rigid far right die face subassembly 124. Central left and right subassemblies 120 and 122 are substantially identical or are mirror images of one another. Likewise, far left and far right subassemblies 118 and 124 are substantially identical and mirror images of one another. Each of these subassemblies includes a metal back plate 126 and a face sheet which includes a metal front primary expansion bar or plate 128 and a series of adjustment plates 130 secured to the front of front plate 128 and formed primarily of metal. The subassemblies further include respective thicker stiff metal ribs 132A-D and a series of thinner metal ribs 134. More particularly, subassembly 118 includes eight of the thinner ribs 134A-H which are longitudinally spaced from one another and to the left of thicker rib 132A. Subassembly 120 has eight of the thinner ribs including four ribs 1341-L which are longitudinally spaced from one another and to the left of stiff thicker rib 132B, and four ribs 134M-P which are likewise longitudinally spaced and to the right of rib 132B. Ribs 1341-L are thus also to the right of rib 132A. Subassembly 122 (FIG. 4D) also has eight of the ribs including four ribs 134Q-T which are positioned to the left of rib 132C and to the right of thinner rib 134P, and four ribs 134U-X which are positioned to the right of thicker rib 132C and to the left of thicker rib 132D. Subassembly 124 also has eight of the thinner ribs including ribs 134Y-134FF which are also longitudinally spaced from one another and to the right of thicker rib 132D.

Figure 8:
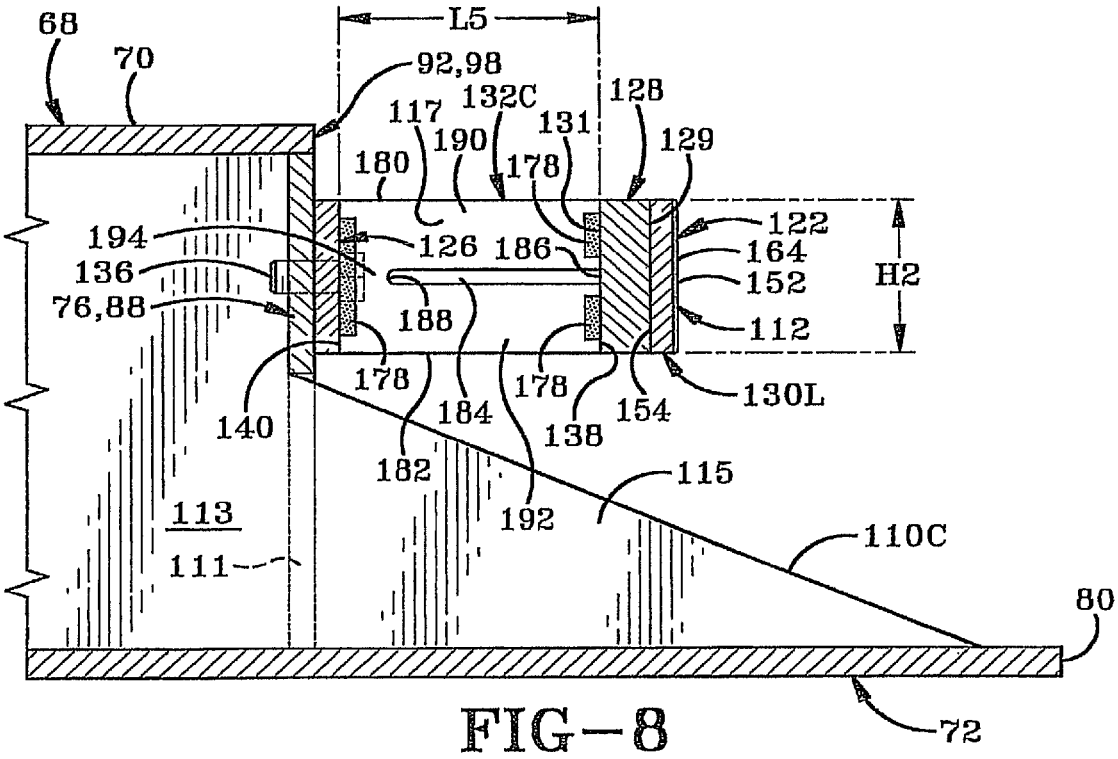
FIG. 8 is an enlarged sectional view taken on line 8-8 of FIG. 6.
Figure 9:
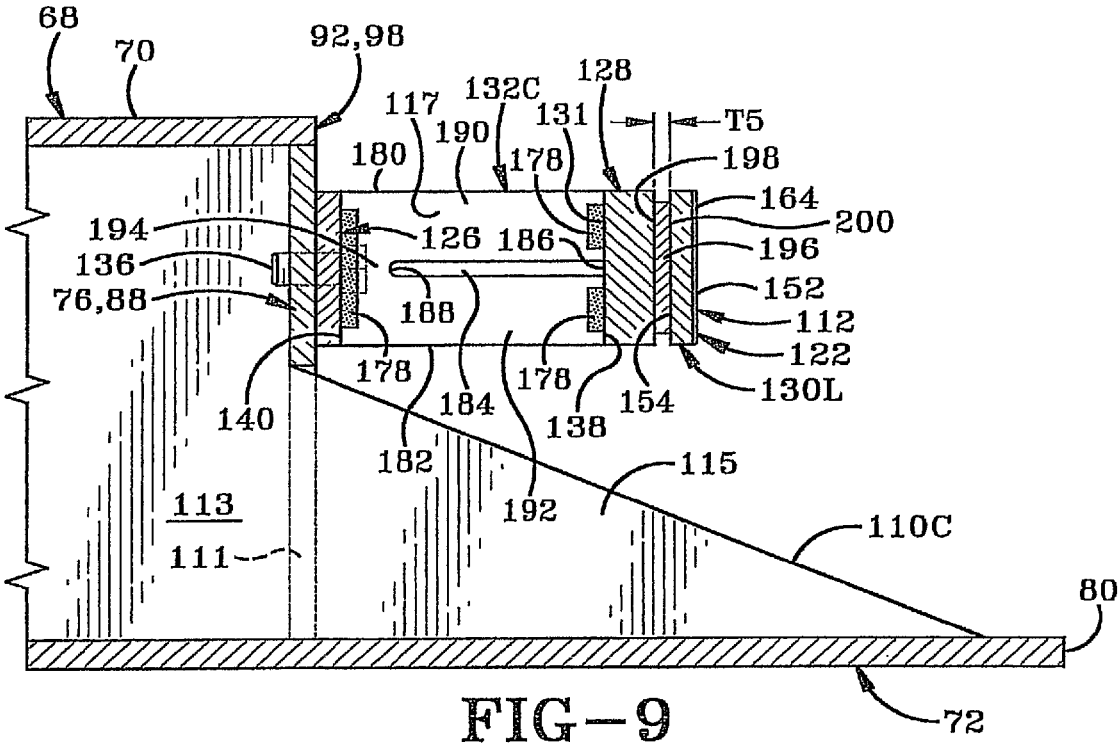
FIG. 9 is similar to FIG. 8 and shows the insertion of a shim between the primary expansion plate or bar of the central right die face subassembly and one of the adjustment plates.

In the exemplary embodiment, ribs 134A-134H and 132A are vertically aligned with and directly above the respective ribs 103A-103H and 110A of set 102. Likewise, ribs 134I-134P and 132B are respectively vertically aligned with and directly above the respective ribs 105A-105H and 110B of set 104. The ribs 134 and 132 in right central die face subassembly 122 are aligned in the same manner with respect to the ribs 107 and 110 in set 106. The ribs 134 and 132 in far right subassembly 124 are also oriented in the same regard with respect to ribs 109 and 110 within set 108. As a result, the corresponding ribs 134 and 132 within the various die face subassemblies similarly define therebetween the corresponding angles a, b and c as discussed previously with reference to the ribs in sets 102, 104, 106 and 108 with reference to FIG. 4. It is further noted that each die face subassembly and its corresponding ribs and other components are spaced upwardly of the triangular sections 115 of the corresponding ribs of sets 102, 104, 106 and 108, as shown in FIGS. 8 and 9. As noted above, ribs 132 and 134 are longitudinally spaced from one another. More particularly, within each given subassembly, the thicker rib 132 and the thinner ribs 134 closest to said rib 132 define therebetween a space 117. In addition, each adjacent pair of thinner ribs 134 defines therebetween a space 119 which is of a similar dimension to space 117. Inasmuch as the hot stretch forming process of the present invention is typically undertaken within an air environment or in another gaseous atmosphere such as an inert gas, spaces 117 and 119 are typically filled with air or another gas. Spaces 117 and 119 are substantially open spaces which are substantially free of solid structures extending therethrough between the corresponding adjacent pair of ribs, the back of bar 128 and the front of plate 126 and bolt 136. Thus, spaces 117 and 119 serve as poor thermal conductors. Each of the subassemblies 118, 120, 122 and 124 is removably mounted on front wall 76 of backing section 68 via a plurality of bolts 136 (FIG. 5) which are threaded into the respective threaded holes formed in front wall 76. FIG. 4C shows subassembly 120 in dot dash lines to illustrate this removable aspect of each of the subassemblies. When each of the subassemblies is mounted on backing section 68, bolts 136 rigidly secure each subassembly thereto.

Expansion plate or bar 128 (FIG. 4A) has a front or front surface 129 and a back or back surface 131. Although bar 128 is generally straight as viewed from above, it is slightly curved such that front surface 129 is convexly curved as viewed from above and back surface 131 is concavely curved as viewed from above in parallel fashion to front surface 129. Bar 128 has left and right ends 133 and 135 which define therebetween a length L3 which in the exemplary embodiment is on the order of about ¼ that of length L1 although this is an approximation and may vary substantially especially where a different number of expansion bars are used. Each of the expansion bars are arranged in a generally end to end fashion such that the adjacent ends of an adjacent pair of the bars 128 are spaced from one another a short distance or gap 137. More particularly, FIG. 4A illustrates that the right end 135 of the far left expansion bar 128 and the left end 137 of the central left expansion bar 128 define therebetween a gap 137 or distance D1 which is typically on the order of about 1/16 to ⅜ inch and more typically ⅛ to ¼ inch or so. FIG. 4A also illustrates that the right end 135 of the central left expansion bar 128 and the left end 133 of the central right expansion bar 128 also define therebetween a gap 137 of a similar size. It is noted that these gaps may be of a different size from one another depending on the specific configuration. For instance, gap 137 between the far left and central left expansion bars 128 may be less than that between the central left and central right bars due to the difference in thermal expansion during hot stretch forming, which will be discussed further below. Typically, distance D1 is kept to a relative minimum in order to provide as much continuous support across the die face as possible for the bending of metal bar 16.

Figure 4E:
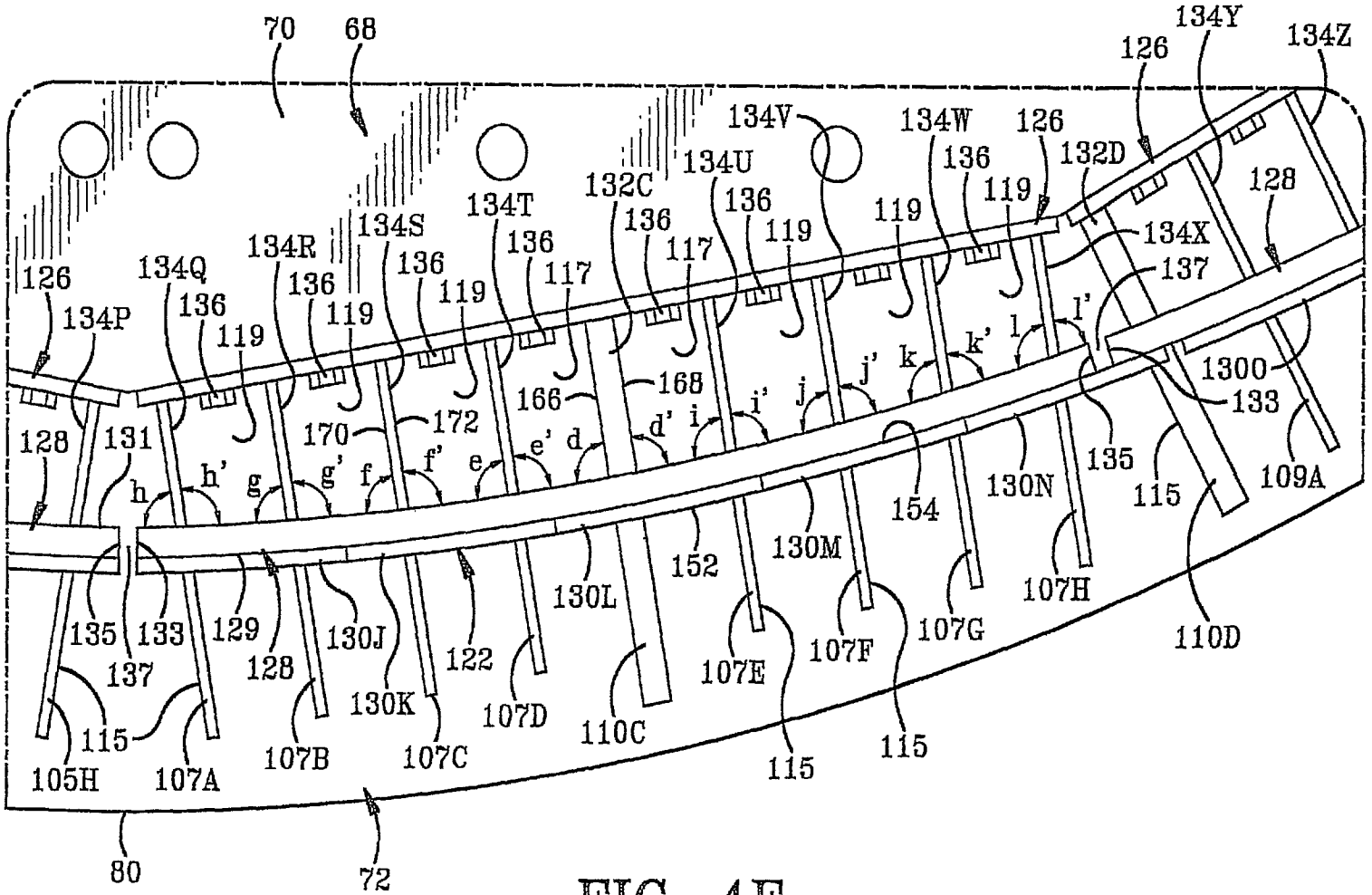
FIG. 4E is an enlarged top plan view of the central right die face subassembly showing the various angles between its main expansion bar and its various ribs in the home position.

In the exemplary embodiment, ribs 132 and 134 of a given die face subassembly are generally perpendicular to the expansion bar 128 of that subassembly. More broadly, ribs 132 and 134 typically extend at an angle within the range of about 75° to 105° to bar 128, and more particularly to a tangent to the curvature of bar 28 at which each given rib intersects bar 128. This orientation of ribs 132 and 134 is illustrated in FIG. 4E with respect to subassembly 122 in the home position of die 10, that is, prior to the stretching and wrapping of the heated metal bar 16 around the die face 112, and thus prior to the thermal expansion which is caused thereby. As previously noted, ribs 134Q-134X of subassembly 122 are parallel to one another. FIG. 4E shows that the left side of rib 132C and rear surface 131 of bar 128 define therebetween angle d, which thus represents the angle between the left side of bar 132C and a tangent to back surface 131, front surface 129 and the front and back surfaces of plates 130. FIG. 4E likewise shows that the right side of bar 132C and back surface 131 of bar 128 define therebetween an angle d' and thus the angle between the right side of rib 132C and either of the front or back surfaces of bar 128 and plate 130 or the tangents thereto. The remaining analogous angles referred to herein will simply make reference to the angle between a given side of the rib and the back surface of bar 128 or be otherwise referred to in an abbreviated manner for simplicity. Thus, the left side of rib 134T and the back surface of bar 128 define therebetween an angle e, while the right side of bar 132T and the back of bar 128 define therebetween an angle e'. FIG. 4E shows analogous angles f and f on either side of rib 134S, angles g and g' on either side of rib 134R, angles h and h' on either side of rib 134Q, angles i and i' on either side of rib 134U, angles j and j' on either side of rib 134V, angles k and k' on either side of rib 134W and angles l and l' on either side of rib 134X. Thus, angles d-h grow progressively smaller while angles d'-h' grow progressively larger. Thus, angle d is slightly larger than angle e, which is slightly larger than angle f, which is slightly larger than angle g, which is slightly larger than angle h, and vice versa for angles d'-h'. Similarly, angle i is slightly smaller than angle d, and angles i-l grow progressively smaller in an incremental fashion. Likewise, angle i' is slightly smaller than angle d', and angles i'-l' grow progressively smaller in an incremental fashion. Thus, the angles defined by the left side of ribs 134Q-134T grow smaller as one moves away from rib 132 while the angle defined by the right sides of said ribs grows larger as one moves away from rib 132. Similarly, the angles defined by the left sides of ribs 134U-134X grow larger as one moves away from rib 132C while the angles defined by the right sides of said ribs grows smaller as one moves away from rib 132C.

Figure 4F:
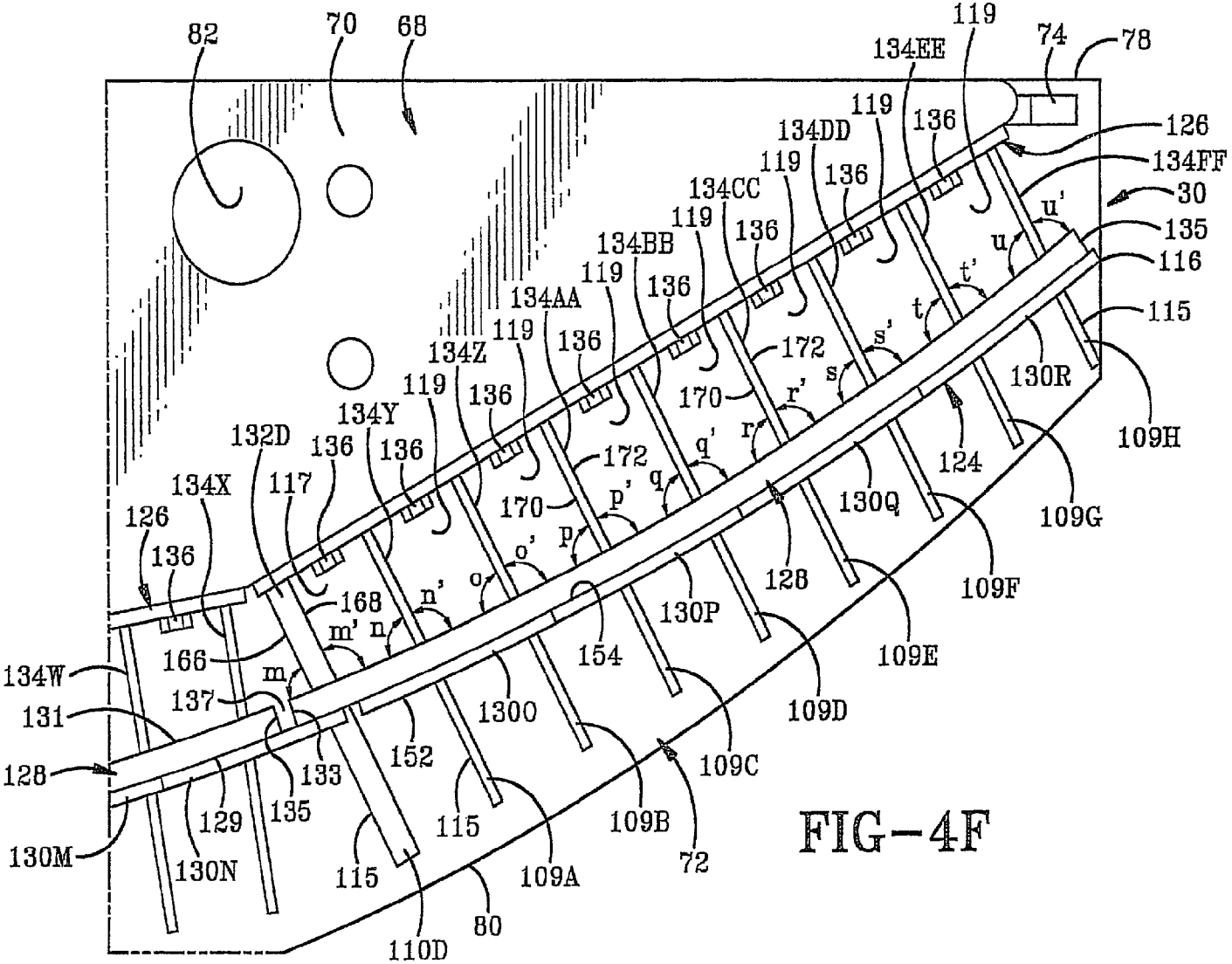
FIG. 4F is similar to FIG. 4E and illustrates the corresponding angles of the far right die face subassembly in the home position.

FIG. 4F shows analogous angles relative to rib 132D and ribs 134Y-134FF. More particularly, FIG. 4 shows angle m and m' respectively on the left and right of stiff rib 132D and respective angles n-u on the respective left sides of ribs 134Y-134FF, and angles in n'-u' on the respective right sides of ribs 134Y and 134FF. Unlike die subassembly 122, which has the single thicker stiff rib 132C located nearly at its longitudinal center, subassembly 124 includes stiff rib 132D located adjacent its left end with all of the thinner ribs 134Y-134FF longitudinally spaced to its right. Thinner rib 134BB is positioned nearly at the longitudinal center of subassembly 124. Thus, angle q and angle q' are approximately the same as angles d and d' of subassembly 122. Thus, various other corresponding angles of subassembly 124 have a very similar relationship to that of subassembly 122 with relation to thinner rib 132C as one moves respectively away from rib 134BB to the left and to the right. Thus, for example, angle q is larger than angle p, which is larger than angle o, which is larger than angle n, which is larger than angle m. The other angles fall within the same patterns as previously described regarding subassembly 122, and thus are not described herein in greater detail.

Figure 5:
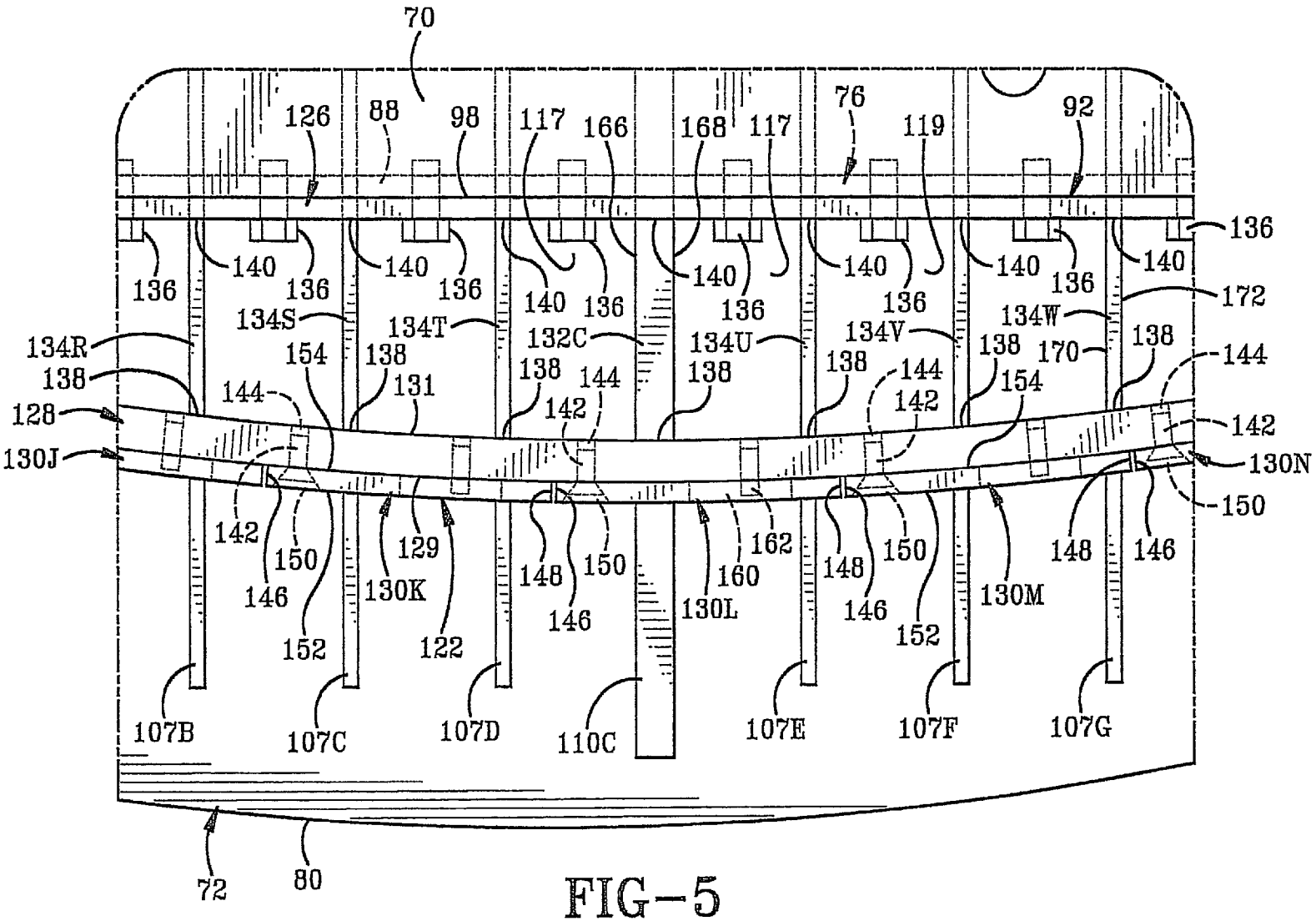
FIG. 5 is an enlarged top plan view of the encircled portion of FIG. 1 primarily illustrating the central right die face subassembly.

The adjustment plates noted above in the exemplary embodiment include 18 adjustments plates 130A to 130R which are generally aligned end to end from left to right across the entire length of die face 112 with respective small gaps therebetween. More particularly, subassembly 18 (FIG. 4C) includes four adjustment plates 130A-D, subassembly 120 includes five adjustment plates 130E-I, subassembly 122 (FIG. 4D) includes five adjustment plates 130J-N and subassembly 124 includes four adjustment plates 130O-R. FIGS. 4C and 4D also illustrate that adjustment plates 130E and 130N serve to overlap the adjacent ends of respective expansion bars 128. More particularly, plate 130E extends across the gap 137 defined between the right end 135 of bar 128 of subassembly 118 and the left end 133 of the bar 128 of subassembly 120. Likewise, plate 130N overlaps the gap 176 between the right end 135 of bar 128 of subassembly 122 and the left end 133 of bar 128 of subassembly 124. As illustrated in FIG. 5, each of ribs 132 and 134 includes respective front and back ends 138 and 140 which are rigidly and non-removably secured respectively to the back of front plate 128 and the front of back plate 126. Each of adjustment plates 130 is, on the other hand, removably secured to the front of front plate 128 by a respective screw 142 having an externally threaded shaft which is removably threaded into a respective internally threaded hole 144 formed in plate 128. More particularly, each adjustment plate 130 has left and right ends 146 and 148, and a countersunk hole 150 is formed from a front surface 152 to a back surface 154 of adjustment plate 130 adjacent one of left and right ends 146 and 148. FIG. 5 illustrates that holes 150 are formed adjacent the respective left end 146 in the adjustment plates 130J-130N of subassembly 122. Similarly, countersunk holes 150 are formed adjacent the respective left ends 146 of the adjustment plates 130O-130R of subassembly 124. However, countersunk holes 144 are formed adjacent the respective right ends 148 in the adjustment plates 130A-130D of subassembly 118 and adjustment plates 130E-130I of subassembly 120. Each adjustment plate 130 has a top 156 (FIG. 6) and a bottom 158 and also defines a horizontal longitudinally elongated slot 160 extending forward from back surface 154 typically to front surface 152. A plurality of longitudinally spaced pins 162 are rigidly secured to and extend forward from plate 128 so that each of the pins 162 is received within a respective slot 160. Although adjustment plates 130 are formed primarily of metal, they may include a thin electrically insulative layer 164 (FIGS. 7, 8), such as a ceramic coating which may be sprayed onto the metal layer. Each adjustment plate 130 serves as a contour plate such that its front surface or face forms a corresponding portion of die face 112. Each of these contour plates thus includes a front contoured surface which is specifically contoured such that the contoured surfaces of plates 130 together form the overall contour of die face 112 against which metal bar 16 is forced when heated such that the back of metal bar 16 forms a mating contoured configuration with die face 112. Thus, the front contoured face of each plate 130 as viewed from above is typically convexly curved such that die face 112 as a whole is also convexly curved from left end 114 to right end 116.

Figure 7:
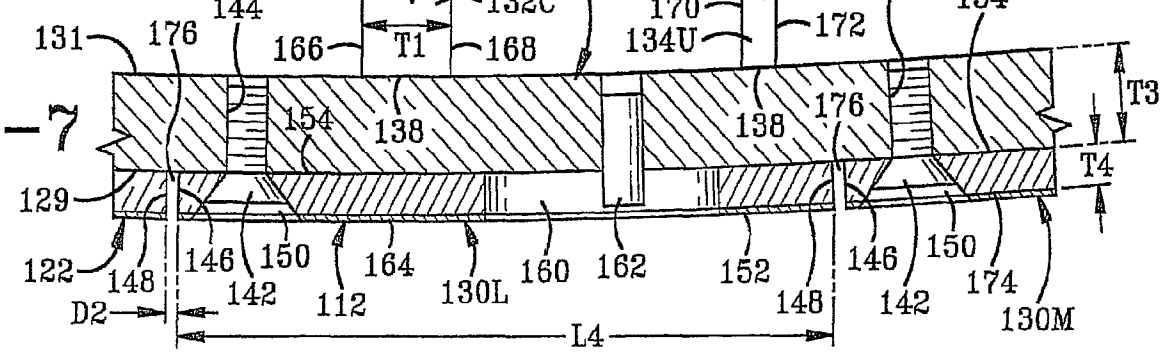
FIG. 7 is an enlarged sectional view taken on line 7-7 of FIG. 6.

Various components of the die face subassemblies are formed with specific dimensions which are chosen to affect the ability of the subassemblies to properly thermally expand and to allow for adjustability of the die face during the hot stretch forming process. For example, thicker stiff ribs 132 have left and right sides 166 and 168 which define therebetween a thickness T1 (FIG. 7) which is typically in the range of about ¾ to 1 inch. Similarly, each rib 134 has left and right sides 170 and 172 defining therebetween a thickness T2 (FIG. 7), which is typically in the range of about ⅛ to ½ inch and in the exemplary embodiment is on the order of about ¼ inch, although this may vary depending on the specific strength needed for the deformation of the metal bar during hot stretch forming. FIG. 7 also shows that the front and back surfaces 129 and 131 of the primary expansion bar 128 define therebetween a thickness T3 which is typically within the range of about % to 1¼ inch and typically on the order of about 1 inch. FIG. 7 also shows that the metal layer of each adjustment plate 130 has a front surface 174 such that the back and front surfaces 154 and 174 define therebetween a thickness T4 of the metal layer of plate 130 which is typically about ⅜ inch and more generally within the range of about ¼ to ½ inch. FIG. 7 also shows that the left and right ends 146 and 148 of each adjustment plate define therebetween a length L4 which may vary but is typically within the range of about 2 to 8 inches, and more typically within the range of about 3 or 4 to 5, 6 or 7 inches. FIG. 7 also shows that each adjacent pair of plates 130 defines therebetween an expansion gap 176 which is more particularly defined between the right end 148 of one plate 130 and the adjacent left end 146 of the adjacent plate 130. Gap 176 is represented in FIG. 7 as distance D2, which is typically only large enough to allow for the longitudinal thermal expansion of each plate 130 during the hot stretch wrap forming process so that die face 112 is nearly continuous from end to end with only the minimal gaps represented by gaps 176.

In the exemplary embodiment, the left half and the right half of die 10 each include eight gaps 176 with an additional gap between the right and left half of die face 112 between central left and central right subassemblies 120 and 122. Thus, the total longitudinal or tangential thermal expansion of die face 112 during the hot stretch forming process may be more or less equally divided by 16 or 17 in order to provide a suitable size for gap 176. For instance, if the total longitudinal thermal expansion of die face 112 is ¼ inch, then gap 176 or distance D2 may be on the order of about 1/64 inch or a little bit more. Similarly, if this total expansion of die face 112 is about ½ inch, then gap 176 or distance D2 may be on the order of 1/32 inch or a little bit more. Thus, gap 176 typically need be no more than 1/16 or 3/32 inch although this may vary depending on the circumstances. In the exemplary embodiment, thicker ribs 110 have the same thickness T1 as thicker ribs 132. Likewise, thinner ribs 103, 105, 107 and 109 have the same thickness T2 as ribs 134. In addition, because thicker ribs 132 are aligned vertically above ribs 110 and thinner ribs 134 are aligned respectively above the thinner ribs 103, 105, 107 and 109, the spacing between ribs 132 and 134 is the same as that between their counterpart ribs. In the exemplary embodiment, the spacing between the centers of ribs 132 and 134 is substantially the same throughout each of the die face subassemblies. As a result, the longitudinal distance of the space 117 between a given thicker rib 132 and the closest thinner rib 134 is illustrated at spacing S1, (FIG. 6) while the longitudinal distance of the space 119 between each adjacent pair of thinner ribs 134 is represented at spacing S2. Inasmuch as the spacing is the same between the various ribs in sets 102, 104, 106 and 108 as noted above, spacing S1 and spacing S2 illustrate the corresponding spacing between the ribs in each of said sets. Although spacing S1 and S2 may vary, they are typically substantially greater than thickness T1 and T2 of ribs 132 and 134. Typically, spacing S1 and S2 are at least as great as thickness T1 and typically at least two or three times thickness T1. Spacing S1 and S2 are also each typically at least two times that of thickness T2 of thinner rib 134, and may be at least three to six times or seven to ten times that of thickness T2 depending on the specific circumstances.

Referring to FIG. 8, the structure of the die face subassembly is described in greater detail. FIG. 8 shows that the front 138 of rib 132C is rigidly secured to back 131 of bar 128 via welds 178. Likewise, the back end 140 of rib 132C is rigidly secured to the front of back plate 126 via a weld 178. Rib 132C has substantially horizontal top and bottom axially extending edges 180 and 182 defining therebetween a height H2 of the rib which may vary substantially. Height H2 is selected in accordance with the size of the metal bar which is to be hot stretch formed against die face 112. Height H2 also represents the vertical dimension of spaces 117 and 119. Height H2 is typically within the range of about 1 to 6 inches although this may vary. FIG. 8 also shows that front and rear ends 138 and 140 define therebetween a length L5 of rib 132C which in the exemplary embodiment is on the order of about 3 to 8 inches and more typically within the range of about 4 to 6 inches although this may vary as well. A horizontal expansion slot 184 is formed in rib 132C extending therethrough from its left side to its right side and from a front end 186 to a back end 188 in the axial direction. Front end 186 extends all the way to front end 138 of rib 132C and thus communicates with the rear surface 131 of bar 128. Back end 188 of slot 184 is on the other hand spaced forward of rear end 140 such that slot 184 divides rib 132C into upper and lower forks 190 and 192 which are secured to a rear base 194 and extend forward therefrom. As shown in FIG. 8, each of the forks 190 and 192 is rigidly secured respectively to an upper and lower half of bar 128 by a respective weld 178. Although FIG. 8 specifically shows rib 132C having a forked configuration, this is likewise true of all of the ribs 132 and ribs 134 in order to achieve the same purpose as discussed further below. Bar 128 and plates 130 have top and bottom edges (not numbered) which are at about the same height as edges 180 and 182 such that these components also have a height about the same as height H2.

FIG. 9 illustrates the use of a shim 196 which is used to adjust the position of the front face 152 of a given adjustment plate 130 in order to likewise adjust the portion of die face 112 represented thereby. Each shim 196 is typically a relatively thin piece of metal having a back surface 198 and a front surface 200 defining therebetween a thickness T5. FIG. 9 exaggerates thickness T5 somewhat in order to more easily make the representation. While thickness T5 may vary, it is typically fairly thin, such as on the order of about 1/32 inch. As will be appreciated, a variety of shims may be used having various thicknesses in order to adjust the axial position of adjustment plate 130 accordingly. For the most part, thickness T5 of a given shim 196 is usually not more than about 1/16 inch, and typically there will be a variety of shims which are 1/32 inch and less. As previously noted, each adjustment plate 130 is removably secured to the front face of bar 128 by screw 142 (FIGS. 6, 7), which may thus be loosened in order to insert shim 196 between the front of plate 128 and the rear of adjustment plate 130. This may be accomplished simply by loosening screw 142 sufficiently to insert the shim 196, or by completely removing screw 142 and plate 130, positioning shim 196 as desired, and reattaching plate 130 along with shim 196 to bar 128. If desired, shim 196 may be formed with a hole and a horizontal slot corresponding to hole 150 and slot 160 such that they are capable of receiving screw 142 and pin 162 respectively.

The operation of apparatus 12 is now described with primary reference to FIGS. 10-13. Prior to the stretching and bending of metal bar 16, power source 18 is operated to pass electrical current through metal bar 16 in order to resistively heat metal bar 16 as previously discussed. Once metal bar 16 has reached its forming temperature, which is typically at least 900° F. and may, for example, reach 1700° F. or so, jaws 14A and 14B are moved away from one another longitudinally as indicated at the arrows in FIG. 1 in order to apply a longitudinal tensile or stretching force along the length of metal bar 16. Typically, this tensile or stretching force is maintained throughout the forming process. Next, jaws 14 are moved in the axial direction toward die 10 so that metal bar 16 likewise moves axially toward die face 112. Although ceramic layer 164 is intended to help prevent electrical contact between metal bar 16 and any metal portion of die 10, it is nonetheless typically preferred to position flexible layer of insulation 22 between die face 112 and metal bar 16 to ensure that metal bar 16 and metal portions of die 10 are electrically isolated from one another throughout the stretch wrap forming process. Thus, as metal bar 16 is moved rearwardly toward die 10, metal bar 16 is in direct contact with flexible layer 22 and/or layer 164. Metal bar 16 may thus not be in direct contact with rigid die face 112 where flexible layer 22 is used.

In any case, the longitudinal center or approximate longitudinal center of metal bar 16 first moves into contact with or presses against the die face via layer 22 at about the longitudinal center of die face 112. As jaws 14 continue their rearward movement relative to die 10, which also includes movement towards one another (arrows A in FIG. 10), more and more of metal bar 16 presses against or closely adjacent die face 112, progressing simultaneously tangentially along die face 112 to the left and right as the bar is gradually bent to its final position shown in FIG. 10. While flexible layer 22 may provide some thermal insulation between metal bar 16 and the various metal components making up die face 112 and its supporting structure, the degree of thermal insulation is relatively minimal and thus a substantial amount of heat is transferred from metal bar 16 to the various metal components adjacent die face 112, thus causing thermal expansion in varying degrees within such components. Thus, with reference to FIGS. 4C and 4D, heat is initially transferred from the hot metal bar 16 to adjustment plates 130I and 130J and subsequently to the right end of bar 128 of subassembly 120 and the left end of bar 128 of subassembly 122. The heat transfer from metal bar 116 to die face 112 and the supporting structure would subsequently occur in a sequential fashion respectively to the left and right simultaneously from this central portion of die face 112 as metal bar 16 progressively comes into close proximity to the respective portions of the die face. Thus for example, heat is first transferred to the left portion of the die beginning at plate 1301 and then sequentially plates 130H-A. Heat is correspondingly transferred in a sequential fashion along the length of bars 128 of subassemblies 120 and 118 from right to left. Likewise, heat is transferred to the right half of die 10 first at plate 130J and then sequentially to plates 130K-130R and also to bars 128 of subassemblies 122 and 124 from left to right. Once metal bar 16 reaches the final wrapped position shown in FIG. 10, it may be held in place there for several minutes to several hours, thus, the expansion of the die face and associated structures may occur over varying time periods.

As noted above, a substantial amount of heat is transferred from metal bar 16 to the various metal components adjacent die face 12, and most particularly to contour plates 130 and expansion bar 128. As noted above, layer 22 provides a relatively minimal amount of thermal insulation and thus plates 130 and bar 128 typically reach a temperature similar to that of metal bar 16. As a result, the increase in temperature of plates 130 and bars 128 during the forming process may easily be within the range of 800 or 900° F. to 1500, 1600 or 1700° F. Even when contour plates 130 and expansion bars 128 are elevated somewhat above room temperature prior to the transfer of heat from metal bar 16, the increase in the temperatures of plate 130 and bars 128 will typically be at least 400, 500 or 600° F.

Figure 11:
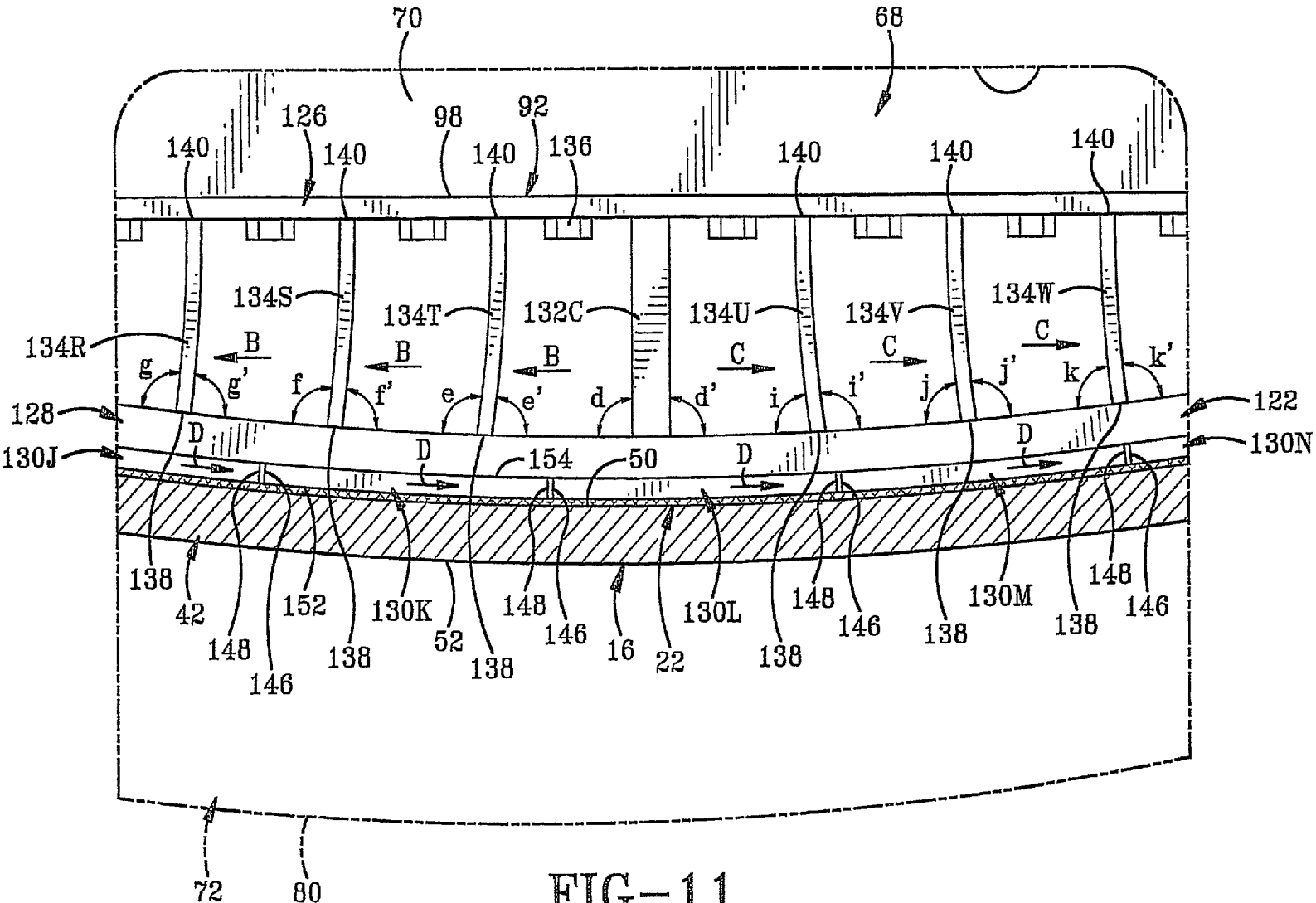
FIG. 11 is an enlarged top plan view of the corresponding encircled portion of FIG. 10 illustrating the longitudinal or tangential thermal expansion of the adjustment plates and the primary expansion bar, as well as the bending or deflecting of the elastically deformable ribs of the central right die face subassembly.

FIG. 11 shows in greater detail the longitudinal or tangential thermal expansion of the adjustment plates 130 and expansion bar 128 of subassembly 122. During this thermal expansion, the thicker stiff rib 132C remains substantially longitudinally or tangentially fixed and thus provides a fixed point relative to which the thermal expansion primarily occurs. Ribs 132 thus serve as substantially non-deflecting members throughout the forming process. As heat is transferred from metal bar 16 through plates 130 to bar 128, bar 128 thermally expands in the longitudinal or tangential direction away from the front end of rib 132C such that left end 133 of bar 128 moves to the left and right end 135 at bar 128 moves to the right. Arrows B illustrate the thermal expansion of bar 128 to the left relative to rib 132C while arrows C illustrate the thermal expansion to the right relative to rib 132C such that left end 133 of bar 128 moves to the left and right end 135 of bar 128 moves to the right. As expansion bar 128 expands to the left as indicated at arrows B, the front ends 138 of the thinner ribs 134 to the left of stiff rib 132C likewise move to the left as the corresponding thinner ribs bend, deflect or deform elastically in response to the thermal expansion of bar 128. FIG. 11 in particular shows the front ends 138 of thinner ribs 134R-T bending in this fashion. Rib 134Q (FIG. 4D) also bends in the same manner although this is not illustrated in FIG. 11. Likewise, FIG. 11 illustrates ribs 134U-134W being deflected or deformed elastically in response to the thermal expansion of bar 128 toward the right (arrows C) such that the front ends 138 thereof also move to the right relative to rib 132C. Rib 134X (FIG. 4D) likewise deflects so that its front end moves to the right. Meanwhile, the back ends 140 of thinner ribs 134 remain substantially stationary inasmuch as the amount of heat transferred rearwardly from expansion bar 128 to back plate 126 and backing section 98 is relatively minimal due to the relatively poor thermal conduction provided by the configuration of ribs 132 and 134 along with spaces 117 and 119. The bending of thinner ribs 134R-134W is exaggerated in FIG. 11 for the purposes of illustration. Comparing FIG. 11 to FIG. 4E, it can be seen that angles d and d' remain substantially the same throughout the process. However, angles e-h and e'-h' on the left of thinner rib 132C are altered during the process, as are angles i-l and i'-l'. More particularly, angles e-h respectively increase and angles e'-h' respectively decrease as the thermal expansion of metal bar 128 increases. Likewise, angles i-l respectively decrease and angles i'-l' respectively increase as the thermal expansion of bar 128 increases. During thermal expansion of bar 128, front end 138 of rib 134T will move a shorter distance to the left than does front end 138 of rib 134S, which likewise moves a shorter distance to the left than does front end 138 of rib 134R, which likewise moves a shorter distance to the left than does front end 138 of rib 134Q, measured relative to the fixed point of the front end 138 of rib 132C. In a similar fashion, the front end 138 of rib 134U moves to the right less than does end 138 of rib 134B, which moves less than end 138 of rib 134W, which moves less than does end 138 of rib 134X relative to rib 132C. Thus, for a given temperature increase due to the transfer of heat from metal bar 16 to expansion bar 128, angle e increases less than does angle f, which increases less than does angle g, which increases less than does angle h. Under the same circumstances, angle i' increases less than does angle j', which increases less than does angle k', which increases less than does angle l'. Likewise, angle e' decreases less than does angle f, which decreases less than angle g', which decreases less than does angle h'. Similarly, angle i decreases less than does angle j, which decreases less than does angle k, which decreases less than does angle l.

FIG. 11 also illustrates the thermal expansion of adjustment plates 130 in the longitudinal or tangential direction. More particularly, FIG. 11 illustrates the thermal expansion of the right portion of each plate 130 at arrows D such that right end 148 of a given adjustment plate 130 moves away from screw 142 and holes 144 and 150 to the right during thermal expansion. Under typical circumstances, plate 130 would expand relative to bar 128 such that right end 148 would move to the right relative to its initial position relative to bar 128. This would be the typical scenario as plates 130 would tend to expand to a greater degree before the expansion of bar 128 whereby slot 160 would move to the right relative to pin 162. However, during the overall thermal expansion of plates 130 and bar 128, the right end 148 of a given adjustment plate 130 might move to the right or left relative to expansion bar 128 depending of the specific temperature of the given plate 130 and bar 128 and the specific materials of which they are formed. The left ends 146 of a given adjustment plate 130 would also tend to move to the left somewhat although to a much lesser degree inasmuch as screw 142 and the corresponding hole 150 is closely adjacent left end 146. In any case, gaps 176 would decrease during the thermal expansion of plates 130 as the corresponding right and left edges 148 and 146 of an adjacent pair of plates 130 moved closer to one another. While said right and left edges of an adjacent pair of plates 130 may come into contact due to the thermal expansion, it is preferred that these edges either do not contact one another or contact one another only to the extent that no buckling is caused in plates 130, which could obviously produce a harmful effect on the contour of die face 112.

Figure 12:
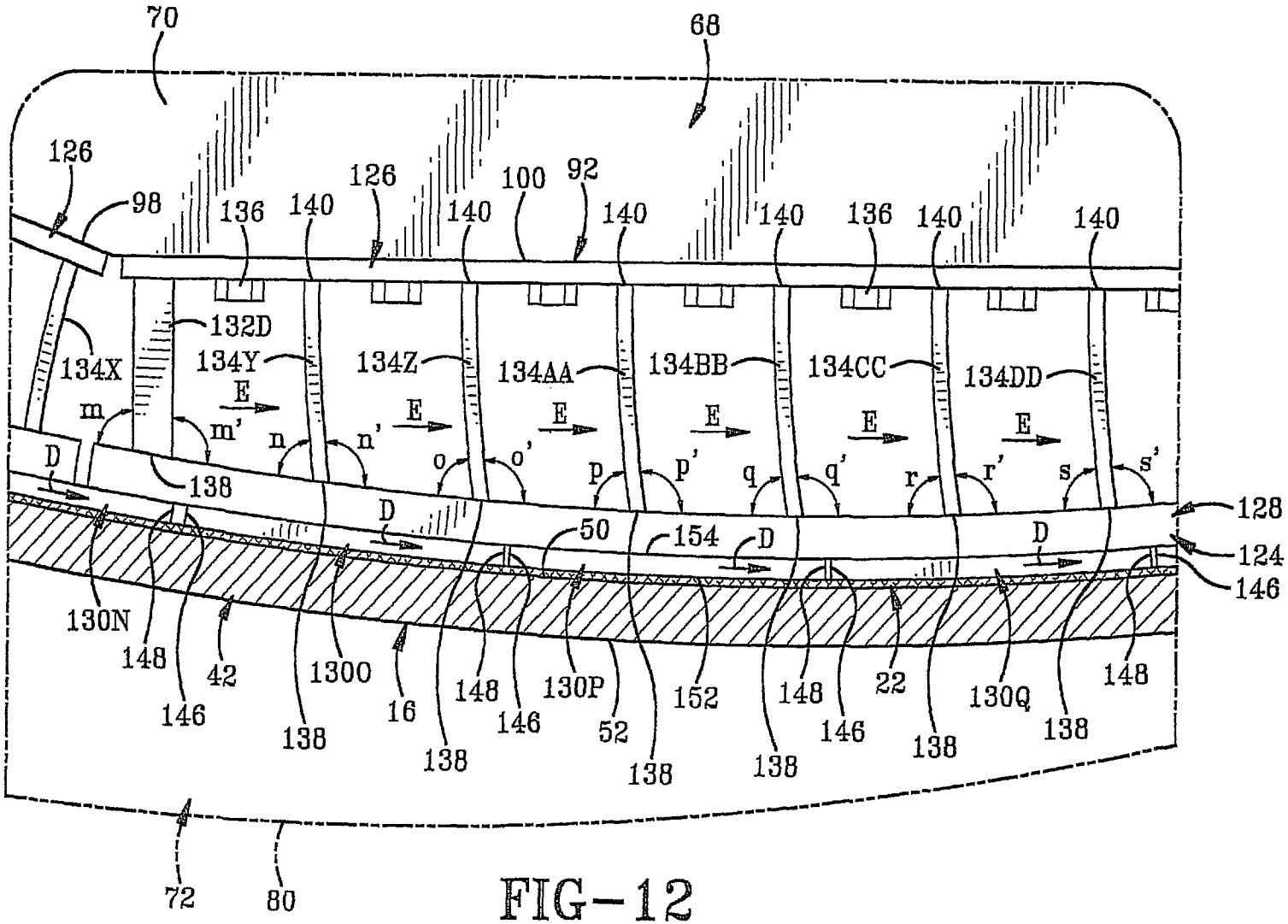
FIG. 12 is an enlarged top plan view of the corresponding encircled portion of FIG. 10 illustrating the longitudinal or tangential thermal expansion of the adjustment plates and main expansion bar, as well as the bending or deflecting of the elastically deformable ribs of the far right die face subassembly.

FIG. 12 likewise illustrates the thermal expansion of plates 130 of subassembly 124 at arrows D in a similar fashion. FIG. 12 also illustrates the thermal expansion of bar 128 of subassembly 124, which is similar to that of bar 128 of subassembly 122 although it varies relative to subassembly 122 due to the positioning of the fixed thicker rib 132D at the left of subassembly 124. Thus, while the outer end 138 of rib 132D provides the fixed point of subassembly 124 during thermal expansion, the front ends 138 of all of the ribs 134Y-134FF move to the right in response to the thermal expansion of bar 128 of subassembly 124. As one moves to the right, the front ends 138 of ribs 134 of subassembly 124 progressively move a greater distance to the right during thermal expansion. Thus, angle n decreases a lesser degree than does angle o, which decreases a lesser degree than does angle p and so forth as discussed with subassembly 122. Similarly, angle n' increases a lesser degree than does angle o', which increases a lesser degree than does angle p' and so forth during the thermal expansion of bar 128 of subassembly 124.

Figure 13:
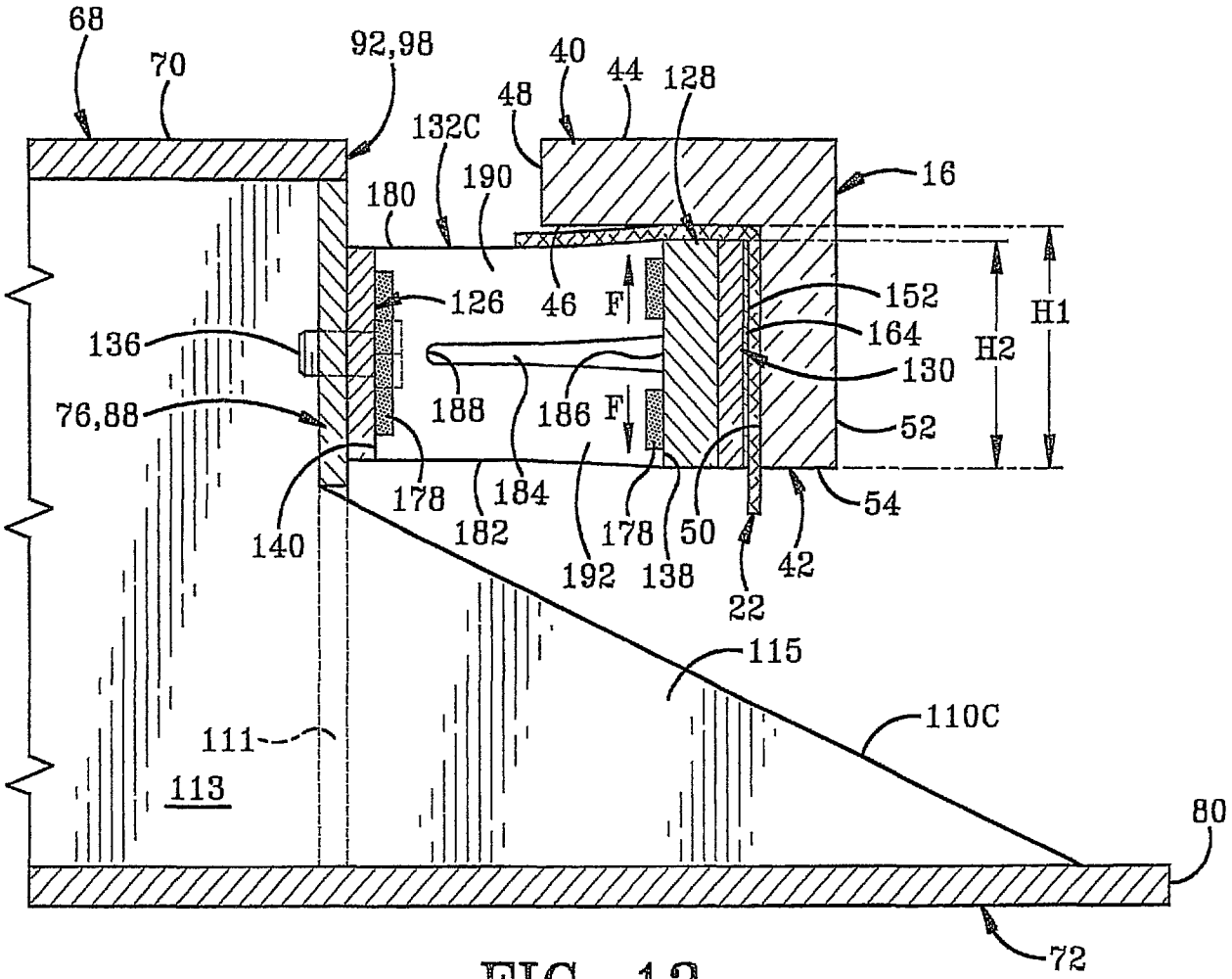
FIG. 13 is an enlarged sectional view similar to FIG. 8 illustrating the vertical thermal expansion of the expansion bar and adjustment plates, as well as the respective upward and downward movement of the upper and lower forks of the forked ribs.

The vertical component of the thermal expansion of the die face and associated structures are represented in FIG. 13. More particularly, FIG. 13 illustrates at arrows F the vertical spreading of upper and lower forks 190 and 192 relative to one another such that the front end of upper fork 190 moves upwardly and the front end of the lower fork 192 moves downwardly in response to the corresponding vertical expansion of bar 128. More particularly, the upper and lower portions of expansion bar 128 move respectively upwardly and downwardly away from one another during thermal expansion, which likewise forces the forks to move as previously noted due to the rigid connection in the forks and metal bar 128. The use of expansion slot 184 thus allows for this vertical expansion without creating forces which would otherwise cause cracks in the ribs or expansion bar. As with the movement of ribs 134 shown in FIGS. 11 and 12, the movement of forks 190 and 192 is exaggerated in FIG. 13 for purposes of illustration. FIG. 13 also illustrates that height H1 of back engagement surface 50 of metal bar 16 and height H2 of die face 112 or front surface 152 are nearly equal. In FIG. 13, height H1 is slightly greater than height H2 although height H1 is often somewhat less than height H2. Thus, typically, height H1 is not substantially greater than height H2 inasmuch as it is generally preferred that the die face provides support to substantially all of surface 50 during the hot stretch wrap forming process.

After the wrapping of metal bar 16 around die face 112 is completed, and after any holding is completed in which metal bar 16 is held in its final position against die face 112, jaws 14 move forward such that metal bar 16 is moved out of contact with die 10. Metal bar 16 is allowed to cool to an ambient temperature. As previously noted, the contour of metal bar 16 may then be checked to determine whether it is within predetermined tolerances so that it can likewise be determined whether die face 112 needs to be adjusted such as by adding shims 196 (FIG. 9), grinding portions of a given contour plate 130, or removing and replacing a given contour plate with one which provides the desired contour. If necessary, additional metal bars may be hot stretch form wrapped around the adjusted die face 112 and subsequently tested in order to make additional adjustments to the die face.

Once metal bar 16 is removed from the die face, the die face begins to cool inasmuch as heat is no longer being transferred from the metal bar to the die face. As the die face cools, the various components which were thermally expanded begin to thermally contract. Thus, expansion bars 128 and adjustments plates 130 thermally contract during this cooling process such that the movement of bars 128, plates 130 and ribs 134 is reversed with respect to the movement described during the thermal expansion process. For instance, plates 130 contract in the direction opposite arrows D in FIGS. 11 and 12 while the respective expansion bars 128 thermally contract in the direction opposite arrows B and C in FIG. 11 and opposite arrows E in FIG. 12. Likewise, fronts ends 138 of the various ribs 134 move in direction opposite arrows B, C and E whereby the various angles described with reference to FIGS. 11 and 12 between the ribs and expansion bars 128 are adjusted in reverse fashion back toward their original values as bars 128, plates 130 and ribs 134 return to the home position. Likewise, the front ends of forks 190 and 192 of the various ribs move in the direction opposite arrows F shown in FIG. 13 during this thermal contraction.

Figure 14:
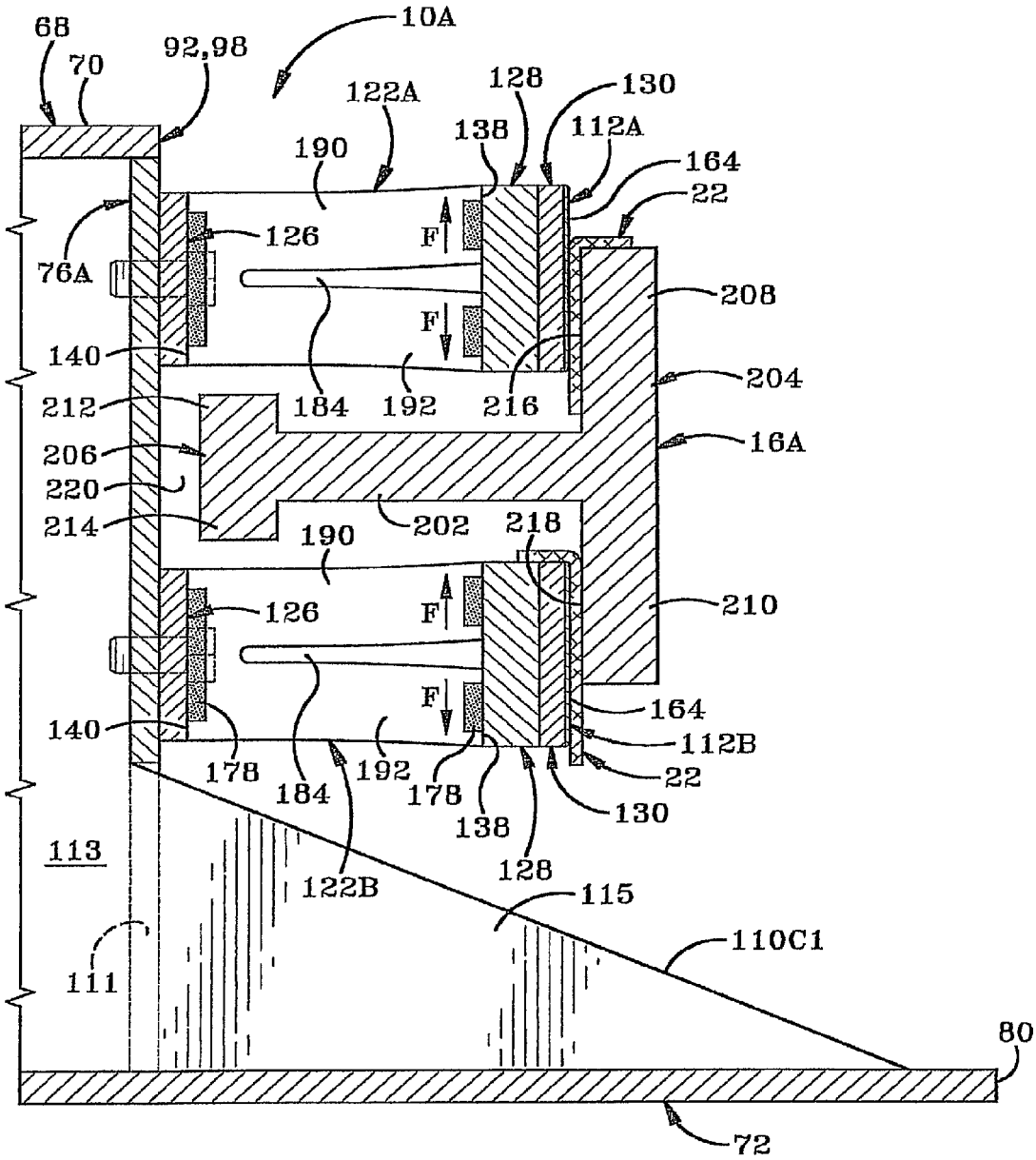
FIG. 14 is similar to FIG. 13 and illustrates a second embodiment of the die which utilizes a pair of the die faces which are vertically spaced from one another to accommodate a metal bar having a different shape.

FIG. 14 shows an alternate metal bar 16A in use with a modified die 10A. Metal bar 16A is similar to metal bar 16 except that it has a different cross sectional shape which is generally I-shaped or T-shaped. Bar 16A includes a horizontal web 202, a longer vertical cross bar 204 secured to the front of web 202, and a shorter vertical cross bar 206 secured to the back end of web 202. Longer cross bar 204 has upper and lower legs 208 and 210 extending respectively upwardly and downwardly opposite from one another. Shorter cross bar 206 likewise has upper and lower legs 212 and 214 extending respectively upwardly and downwardly from one another and web 202 although a shorter distance than do legs 208 and 210. Upper leg 208 has a vertical upper rear engagement face 216. Likewise, lower leg 210 has a vertical lower rear engagement face 218 which is vertically aligned with face 216. Each of faces 216 and 218 serve as the engagement faces which are forced against or closely adjacent to the die face of the modified die 10A during the hot stretch wrap forming process.

Die 10A is similar to die 10 except that it has been configured with upper and lower vertically spaced die faces 112A and 112B. More particularly, die faces 112A and 112B are respectively substantially identical to die face 112 of die 10 and are vertically aligned with one another. Die faces 112A and 112B are thus respectively defined by various adjustment plates 130 of the corresponding die face subassemblies, such as subassemblies 122A and 122B, which serve as upper and lower central right die face subassemblies having a configuration the same as that of subassembly 122 of die 10. The upper and lower die face subassemblies define therebetween a bar-receiving space 220 for receiving therein web 202 and shorter cross bar 206 of metal bar 16A during the forming process. To accommodate the upper and lower die face assemblies, die 10A includes for example a taller front wall 76A and ribs such as rib 110C1 which includes a taller rectangular portion extending from bottom wall 72 to top wall 70, which is thus approximately the same height as the taller front wall 76A.

The overall operation of die 10A is substantially the same as that of die 10 except that engagement faces 216 and 218 of metal bar 16A are pressed against respective pieces of electrical insulation 22 and die faces 112A and 112B in order to form metal bar 16A to create a mating configuration with the contour of die faces 112A and 112B.

Thus, dies 10 and 10A of the present invention provide improvements in the ability to hot stretch form a heated metal bar using a metal die face which better accommodates the thermal expansion of the die face in response to the heat transferred from the heated metal bar to the die face during the operation. For instance, the various ribs 132 and 134 of the present invention and the spaces 117, 119 therebetween provide relatively poor thermal conduction from the primary expansion bars 128 to the back plates 126 and the remainder of backing section 98 such that relatively little thermal expansion is created in the backing section as a result of heat transferred from the heated metal bar. As a result, the backing section is protected from the continuous expansion and contraction that would otherwise occur. In addition, the ribs 134 allow for more suitable expansion of the expansion bars 128 to allow a better conformity to the desired ultimate contour of the die face in order to better control the final contour of the metal bar. Furthermore, the various forked ribs of the present invention allow for the vertical expansion of the primary expansion bars without damaging various components of the die face supporting structure. Moreover, the use of adjustment plates to form the die face allows for better control of the ultimate contour of the metal bar. This is possible in part due to the ability to use shims to adjust the position of the adjustment plates, as well as the ability to reshape or replace the individual adjustment plates instead of having to grind or otherwise remove material from a large single piece die face, which is substantially more difficult and more expensive if mistakes are made during this process.

It will be appreciated that various changes may be made to the present die which are within the scope of the present invention. One of these changes is the option of forming ribs analogous to ribs 132 and 134 integrally with the other ribs described herein, such as ribs 103, 105, 107, 109 and 110. For example and with reference to FIG. 5, a single thicker rib can be formed analogous to the combination of rib 110C and 132C. Likewise, a thinner rib may be formed analogous to the combination of rib 107E and rib 134U. All of the analogous ribs may be formed in this fashion if desired. This type of configuration would eliminate the removable type of die face subassemblies described herein. Thus, for instance, plate 126 and bolts 136 may be eliminated in such a configuration. Other changes will be evident to one skilled in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A hot stretch wrap forming die comprising:

a support structure having a front and back defining therebetween an axial direction, left and right ends defining therebetween a longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

wherein each of the contour plates has a first secured position secured to the support structure and an alternate second secured position secured to the support structure forward of the first secured position; and each adjacent pair of contour plates defines therebetween an expansion gap to allow for longitudinal thermal expansion of each contour plate during the wrapping of the heated metal bar around the die face.

2. The die of claim 1 wherein the forward-facing surface of the support structure has a top and a bottom; and each contour plate has a top edge adjacent the top of the forward-facing surface and a bottom edge adjacent the bottom of the forward-facing surface.

3. The die of claim 1 wherein the contour plates are removably secured to the support structure.

4. The die of claim 1 further comprising a plurality of pins extending between the support structure and the contour plates respectively; and a plurality of longitudinally elongated slots formed in one of (a) the support structure and (b) the contour plates respectively;

wherein the support structure and contour plates are configured to allow thermal expansion of each contour plate in the longitudinal direction relative to the support structure with the pins in the slots respectively.

5. The die of claim 4 further comprising a shim positioned between the forward-facing surface of the support structure and a first one of the contour plates in the second secured position of the first contour plate; and a longitudinally elongated slot formed in the shim;

wherein one of the pins is in the slot formed in the shim.

6. A hot stretch wrap forming die comprising:

a support structure having a front and back defining therebetween an axial direction, left and right ends defining therebetween a longitudinal direction, and a forward-facing surface which is convex as viewed from above a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

wherein each of the contour plates has a first secured position secured to the support structure and an alternate second secured position secured to the support structure forward of the first secured position; and further comprising a shim positioned between the forward-facing surface of the support structure and a first one of the contour plates in the second secured position of the first contour plate.

7. The die of claim 6 further comprising a threaded fastener extending from the shim to the support structure.

8. The die of claim 7 wherein the threaded fastener extends from the first contour plate through the shim to the support structure.

9. The die of claim 6 further comprising a threaded fastener extending from the first contour plate to the support structure.

10. The die of claim 6 wherein each adjacent pair of contour plates defines therebetween an expansion gap to allow for longitudinal thermal expansion of each contour plate during the wrapping of the heated metal bar around the die face.

11. A hot stretch wrap forming die comprising:

a support structure having a front and back defining therebetween an axial direction, left and right ends defining therebetween a longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

wherein each of the contour plates has a first secured position secured to the support structure and an alternate second secured position secured to the support structure forward of the first secured position; and each contour plate has a back surface which is in contact with the forward-facing surface of the support structure in the first secured position and out of contact with the forward-facing surface of the support structure in the second secured position.

12. The die of claim 11 further comprising a plurality of threaded fasteners which respectively extend from the contour plates to the support structure.

13. The die of claim 12 wherein the contour plates define respective holes which respectively receive the threaded fasteners.

14. The die of claim 13 wherein the series of contour plates comprises a first plurality of the contour plates and a second plurality of the contour plates positioned to the right of the first plurality of the contour plates;

the holes in the first plurality of contour plates are respectively formed adjacent respective right edges thereof and distal respective left edges thereof; and the holes in the second plurality of contour plates are respectively formed adjacent respective left edges thereof and distal respective right edges thereof.

15. A hot stretch wrap forming die comprising:

a support structure having a front and back defining therebetween an axial direction, left and right ends defining therebetween a longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

wherein each of the contour plates has a first secured position secured to the support structure and an alternate second secured position secured to the support structure forward of the first secured position; and each of the contour plates comprises a metal layer having a front surface, and an electrically insulative layer which is secured to the front surface of the metal layer and forms the front face of the respective contour plate.

16. The die of claim 15 wherein the contour plates have respective back faces; and further comprising a plurality of holes respectively formed in the contour plates extending from the respective front faces to the respective back faces; and a plurality of threaded fasteners which include respective portions in the holes and which respectively extend from the contour plates to the forward-facing surface of the support structure to removably secure the contour plates to the forward-facing surface.

17. A hot stretch wrap forming die comprising:

a support structure having a front and back defining therebetween an axial direction, left and right ends defining therebetween a longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

wherein each of the contour plates has a first secured position secured to the support structure and an alternate second secured position secured to the support structure forward of the first secured position; and the support structure comprises first and second die face subassemblies which include respective first and second front surfaces which are convexly curved as viewed from above and form part of the forward-facing surface;

a right end of the first front surface and a left end of the second front surface define therebetween a longitudinal gap; and one of the contour plates overlaps the gap.

18. A hot stretch wrap forming die comprising:

a support structure having a front and back defining therebetween an axial direction, left and right ends defining therebetween a longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

wherein each of the contour plates has a first secured position secured to the support structure and an alternate second secured position secured to the support structure forward of the first secured position; and the support structure includes a first die face subassembly and a second die face subassembly to the right of the first die face subassembly wherein the first and second die face subassemblies have respective first and second front surfaces which are convexly curved as viewed from above and which form part of the forward-facing surface;

a first plurality of the contour plates are secured to the first die face subassembly; and a second plurality of the contour plates are secured to the second die face subassembly.

19. A hot stretch wrap forming die comprising:

a support structure having a front and back defining therebetween an axial direction left and right ends defining therebetween longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

wherein each of the contour plates has a first secured position secured to the support structure and an alternate second secured position secured to the support structure forward of the first secured position; and further comprising a plurality of longitudinally spaced pins which are secured to the support structure and extend forward beyond the forward-facing surface;

wherein the contour plates are configured to thermally expand in the longitudinal direction relative to the support structure and pins while the pins respectively engage longitudinally elongated edges of the contour plates.

20. A hot stretch wrap forming die comprising:

a support structure having a front and back defining therebetween an axial direction, left and right ends defining therebetween a longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face;

a series of contour plates having respective front faces which form respective portions of the die face and having respective back faces, and which are removably secured to the forward-facing surface;

a plurality of holes respectively formed in the contour plates extending from the respective front faces to the respective back faces; and a plurality of threaded fasteners which include respective portions in the holes and which respectively extend from the contour plates to the forward-facing surface of the support structure to removably secure the contour plates to the forward-facing surface.

21. The die of claim 20 wherein the holes are countersunk holes; and the threaded fasteners have respective heads in the countersunk holes.

22. A hot stretch wrap forming die comprising:

a support structure having a front and back defining therebetween an axial direction, left and right ends defining therebetween a longitudinal direction, and a forward-facing surface which is convex as viewed from above;

a forward-facing die face which is directly forward of the forward-facing surface, which is convex as viewed from above and against which a heated metal bar may be forced so that the metal bar assumes a mating configuration with the die face; and a series of contour plates having respective front faces which form respective portions of the die face;

a plurality of longitudinally elongated slots formed in one of (a) the support structure and (b) the contour plates respectively;

a plurality of pins which extend between the support structure and the contour plates respectively;

wherein the support structure and contour plates are configured to allow thermal expansion of each contour plate in the longitudinal direction relative to the support structure with the pins in the slots respectively.

23. The die of claim 22 wherein each of the contour plates has a first secured position secured to the support structure and an alternate second secured position secured to the support structure forward of the first secured position.

24. The die of claim 22 further comprising a shim positioned between the forward-facing surface of the support structure and a first one of the contour plates in the second secured position of the first contour plate; and a longitudinally elongated slot formed in the shim;

wherein one of the pins is in the slot formed in the shim.

* * * * *